United States Patent [19]

Ogawa et al.

[11] Patent Number: 4,686,175

[45] Date of Patent: Aug. 11, 1987

[54] SILVER HALIDE MULTI-LAYERED COLOR PHOTOGRAPHIC LIGHT SENSITIVE MATERIAL

[75] Inventors: Tadashi Ogawa; Masaki Okazaki, both of Kanagawa, Japan

[73] Assignee: Fuji Photo Film Co., Ltd., Kanagawa, Japan

[21] Appl. No.: 788,516

[22] Filed: Oct. 18, 1985

Related U.S. Application Data

[63] Continuation of Ser. No. 571,764, Jan. 18, 1984, abandoned.

[30] Foreign Application Priority Data

Jan. 19, 1983 [JP] Japan ..... 58-7154

[51] Int. Cl.[4] ..... G03C 1/40; G03C 1/46; G03C 1/08; G03C 7/26

[52] U.S. Cl. ..... 430/505; 430/957; 430/544

[58] Field of Search ..... 430/505, 544, 957

[56] References Cited

U.S. PATENT DOCUMENTS 4,306,015 12/1981 Haylett ..... 430/957
4,414,308 11/1983 Hamada ..... 430/957

*Primary Examiner*—John E. Kittle
*Assistant Examiner*—Mukund J. Shah
*Attorney, Agent, or Firm*—Sughrue, Mion, Zinn, Macpeak and Seas

[57] ABSTRACT

A silver halide multilayered color photographic light-sensitive material is disclosed. The material is comprised of a support basde having thereon a green-sensitive emulsion layer having a maximum sensitivity of from 535 nm to 555 nm, a blue-sensitive emulsion layer having a maximum sensitivity in the range of 80 to 110 nm shorter than that of the green-sensitive layer and a red-sensitive layer having a maximum sensitivity in the range of 75 to 95 nm longer than that of the green-sensitive layer. The material also contains a compound capable of releasing a diffusible development inhibitor or its precursor by a coupling reaction with the oxidation product of a color developing agent. This compound is present within one of the emulsion layers or a light-insensitive layer adjacent to one of the silver halide emulsion layers. The material undergoes less changes in color reproducibility due to changes in color temperature of a light source upon photographing. Further, the material can reproduce color with high saturation and high fidelity.

29 Claims, No Drawings

SILVER HALIDE MULTI-LAYERED COLOR PHOTOGRAPHIC LIGHT SENSITIVE MATERIAL

This is a continuation of application Ser. No. 571,764, filed Jan. 18, 1984, now abandoned.

FIELD OF THE INVENTION

This invention relates to a silver halide multilayered color photographic light-sensitive material and, more particularly, to a silver halide multilayered color photographic light-sensitive material which undergoes less change in color reproduction due to changes in the color temperature of the light source upon photographing and yet possesses good color reproducibility.

BACKGROUND OF THE INVENTION

As is well known, ordinary silver halide multilayered color photographic light-sensitive materials are obtained by coating a red-sensitive silver halide emulsion layer containing a cyan dye-forming coupler, a green-sensitive silver halide emulsion layer containing a magenta dye-forming coupler, and a blue-sensitive silver halide emulsion layer containing a yellow dye-forming coupler one on the other on a support.

Usually, the red-sensitive layer responds to the light of 600 to 700 nm in wavelength, the green-sensitive layer to the light of 500 to 600 nm, and the blue-sensitive layer to the light of 400 to 500 nm. However, these color sensitivities are not definite in the respective wavelength regions, but each layer has a particular spectral wavelength distribution depending upon the kinds of spectrally sensitizing agents and other materials used. Thus, the peak position and the overlap in spectral sensitization distribution differ depending upon the selection and the combination of the sensitizers and other materials. This is one great factor which governs color reproducibility of a color light-sensitive material.

In view of recent technical progress of silver halide multilayered color photographic light-sensitive materials, good color reproduction can be obtained as long as exposure conditions upon photographing and subsequent processings, printing, and projecting conditions are appropriate. However, if these conditions or procedures are inappropriate, satisfactory color reproduction is not always obtained. The interests of those skilled in the art have conventionally been directed to the solution of this problem by improving color photographic light-sensitive materials. Exposure conditions upon photographing include exposure amount, exposure time, light amount distribution of photographed object (lighting conditions), color temperature of light source, and the like. For example, as to improvement of color reproduction of a particular blue color, Japanese Patent Application (OPI) No. 20926/78 (the term "OPI" as used herein refers to a "published unexamined Japanese patent application") describes the technique of shifting the spectral sensitivity wavelength of a less sensitive layer of red-sensitive layers to the shorter wavelength side and, as to dependency on the color temperature of a light source, Japanese Patent Publication No. 6207/74 describes that good color reproduction can be obtained for exposure using various light sources by bringing the form of the spectral sensitivity distribution of each silver halide light-sensitive layer into harmony with a certain target curve through selection of a spectral sensitizer and a filter dye.

In these techniques, overlap between spectral sensitivity distribution of the red-sensitive layer and that of the green-sensitive layer is made larger, which concurrently causes color mixing (color stain) due to poor color separation, resulting in reduction of saturation. Poor color separation can be prevented by selecting a spectral sensitizer which possesses a sharply ending spectral absorption spectrum. However, actually existing spectral sensitizers possess a limited sharpness, with sharpness on the shorter wavelength end being particularly difficult to attain. The shorter wavelength end can be sharply cut to some extent by using a filter layer as described in Japanese Patent Publication No. 6207/74 which, however, concurrently influences spectral sensitivity distribution or reduces sensitivity of other layer possessing light absorption in the region corresponding to the absorption wavelength region of the filter.

In general, in order to reduce change in color reproducibility caused by change in color temperature of a light source upon photographing, particularly a gentle change in color temperature over the entire visible region, it is effective to shift the main region of the spectral sensitivity distribution of blue-sensitive layer to the longer wavelength side, and that of red-sensitive layer to the shorter wavelength side, i.e., to narrow the mutual gaps between the blue-sensitive layer, green-sensitive layer, and red-sensitive layer in spectral sensitivity distribution. This, however, is liable to cause deterioration of color separation as described above, leading to reproduction of color with less saturation. On the other hand, when the gaps in spectral sensitivity distribution between the blue-sensitive layer, green-sensitive layer and red-sensitive layer are broadened, color separation is not deteriorated and, therefore, saturation is not reduced. However, change in color reproducibility to be caused by change in color temperature of a light source becomes so much that good color reproducibility can be obtained only by using a specific light source and, in an extreme case, colors with subtle color difference are reproduced as one and the same color.

Color photographic light-sensitive materials are expected to reproduce various colors just as they are viewed by the eye. Colors that people recognize through the visual organ are influenced by the absorption or emission spectral distribution of an object and by the color temperature of a light source which lights the object. The difference of the color temperature of light source is recognized only as a comparatively small difference for the eye, whereas it is detected as a larger difference by color photographic light-sensitive materials. One reason for this is that relative sensitivities of three spectral sense organs of human visual sensation change depending upon the color temperature and brightness of a light source, and another reason is that spectral sensitivity distributions of the three sense organs are different from that of color photographic light-sensitive materials. The difference in spectral sensitivity distribution between the sense organs and the color photographic light-sensitive materials causes such phenomenon as that, while a color reproduced by a color photographic light-sensitive material is recognized as the same color as is directly viewed by the eye, another color is recognized as an absolutely different color.

Spectral sensitivities of the human eye have peaks at about 445 nm, 540 nm, and 605 nm, respectively, for the three sense organs. Most of the present commercially available color photographic materials, for example, color negative films, are known to have a peak of a blue-sensitive layer at a wavelength shorter than 445 nm, a peak of a green-sensitive layer at a wavelength somewhat longer than 540 nm, and a peak of a red-sensitive layer at a wavelength considerably longer than 605 nm. This means that when photographing is conducted under tungsten light which has such spectral distribution in the visible region that the longer wavelength component is relatively longer than shorter wavelength component in comparison with day light using a color negative film whose color balance is adjusted for day light. Accordingly, images with orange tint more intense than is viewed by the eye are reproduced. This can be avoided by shifting the spectral sensitivity of the red-sensitive layer to a shorter wavelength side. However, as has been described hereinbefore, such shift increases the overlap between the spectral sensitivity regions of the layers and deteriorates color reproducibility due to poor color separation.

It is abstractly known to use DIR couplers for the improvement of color reproduction. However, conventionally known DIR couplers are not fully satisfactory with respect to the effect of improving color reproduction and are absolutely powerless in avoiding deterioration of color reproduction when increasing the overlap between the spectral sensitivity distributions as described above.

SUMMARY OF THE INVENTION

An object of the present invention is to provide a novel silver halide multilayered color photographic material and, more particularly, a silver halide multilayered color photographic material which undergoes less change in color reproducibility due to changes in color temperature of a light source upon photographing, and which can reproduce color with high saturation and high fidelity.

The inventors have found that a photographic multilayered light-sensitive material which has less dependence upon color temperature of the light source upon photographing and which can reproduce color with high saturation and high fidelity can be obtained by selecting respective spectral sensitivity regions of the blue-sensitive layer, green-sensitive layer and red-sensitive layer as predetermined and incorporating in one or each of the multilayers a DIR compound capable of releasing a diffusible development inhibitor or its precursor by coupling reaction with the oxidation product of a color developing agent.

DETAILED DESCRIPTION OF THE INVENTION

The object of the present invention cannot be attained by mere selection of the spectral sensitivity regions as predetermined. Independent selection of the spectral sensitivity regions causes inconveniences in color reproduction such as reduction in saturation and change in color due to poor color separation, though dependence upon the color temperature of the light source is improved. On the other hand, independent incorporation of the DIR compound fails to attain the objects of the present invention. Dependence upon the color temperature of the light source is not improved but rather deteriorated, though saturation is improved.

Good color reproducibility with less change for the change in color temperature of light source and with high saturation and high fidelity can be attained only by a color photographic light-sensitive material of the present invention which has the spectral sensitivities selected as predetermined and which contains the DIR compound capable of releasing a diffusible development inhibitor or its precursor.

Spectral sensitivity distributions suited for attaining the object of the present invention are such that spectral sensitivity distributions of the blue-sensitive, green-sensitive and red-sensitive layers coincide with those of the three sense organs of the eye. However, the inventors have found that color reproduction of current color photographic light-sensitive materials can be fully improved even when the distributions do not completely coincide.

Results of the inventors have revealed that the object of the present invention can be attained by setting maximum sensitivity of a green-sensitive layer at 535 to 555 nm, maximum sensitivity of a blue-sensitive layer at a wavelength 80 to 110 nm shorter than that, and maximum sensitivity of a red-sensitive layer at a wavelength 75 to 95 nm longer than that of the green-sensitive layer and incorporating the aforesaid DIR compound capable of releasing a diffusible development inhibitor (or its precursor) (hereinafter referred to as a diffusible DIR compound). Therefore, spectral sensitivity regions of the blue-sensitive, green-sensitive and red-sensitive layers of the present invention are not limited as to primitive emulsions and spectral sensitizer to be used. However, the best results are obtained by using, for example, spectral sensitizers of the following structures.

Sensitizers for Blue-Sensitive Emulsion

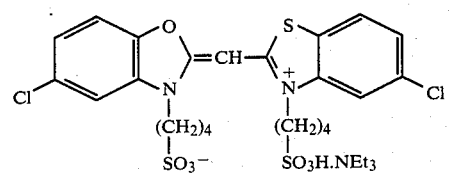

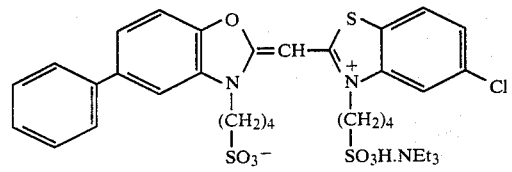

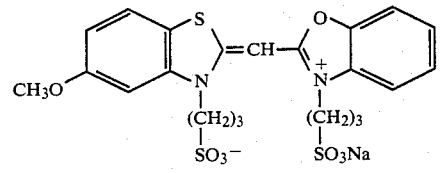

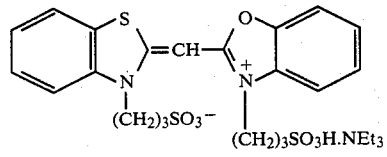

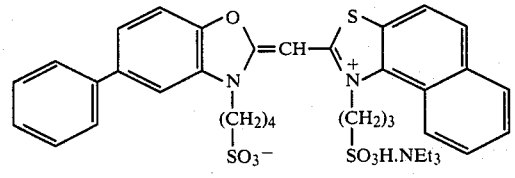

-continued
Sensitizers for Blue-Sensitive Emulsion
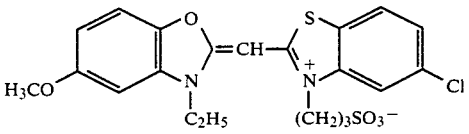
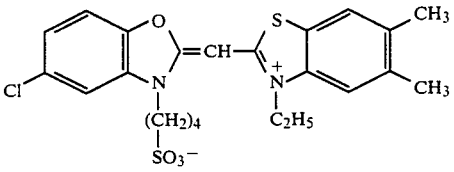
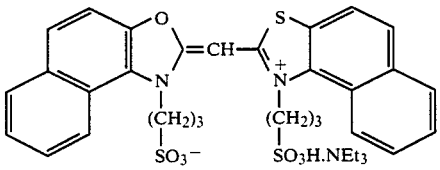
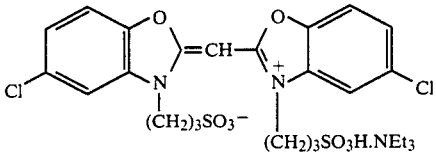
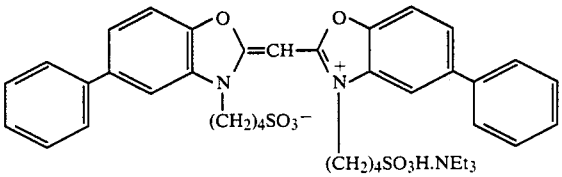
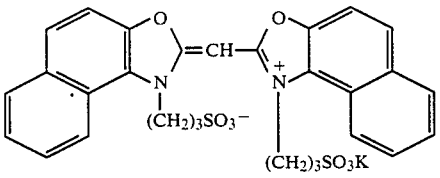
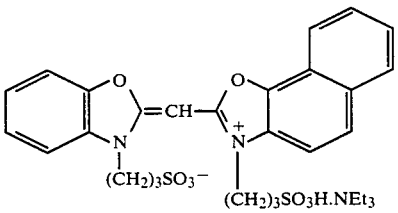
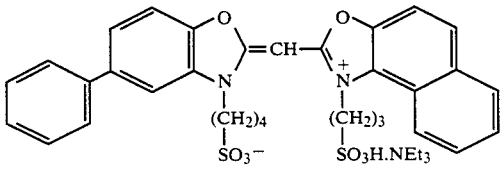
-continued
Sensitizers for Blue-Sensitive Emulsion
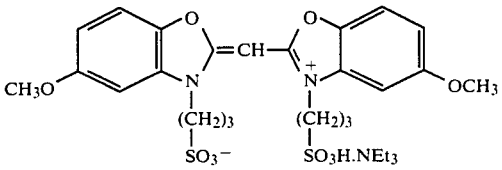
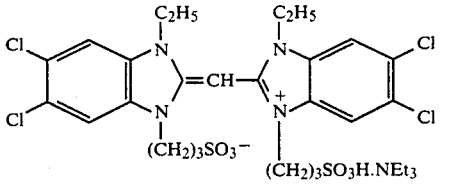
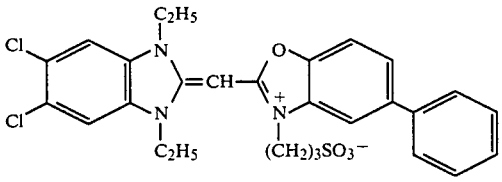
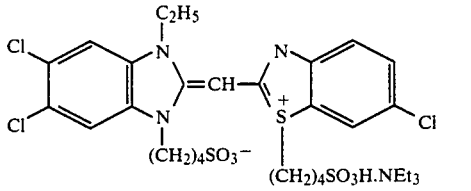
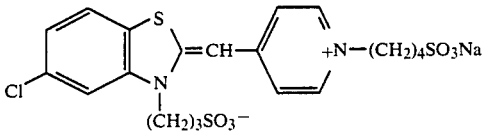
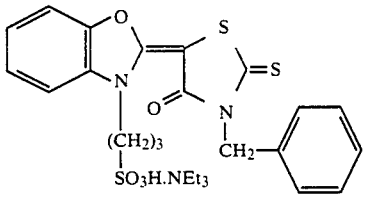
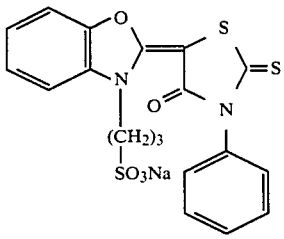
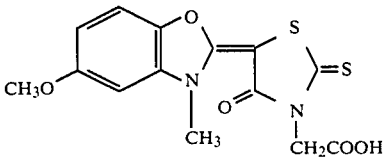

-continued
Sensitizers for Blue-Sensitive Emulsion
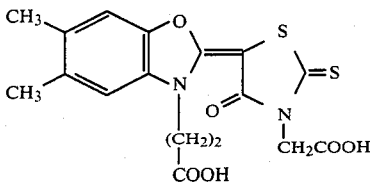
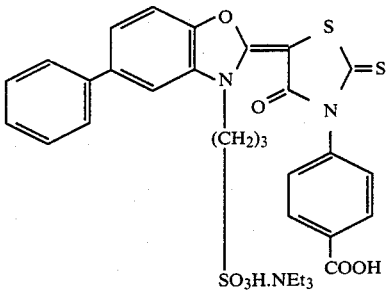
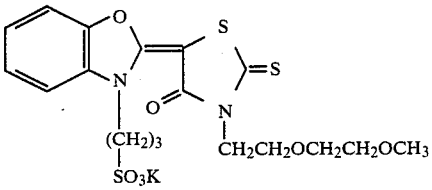
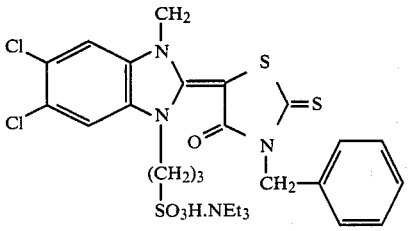
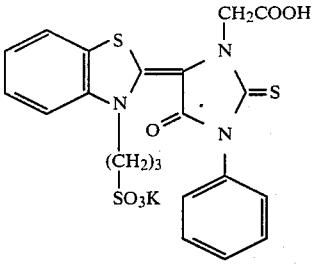
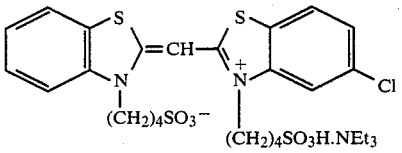
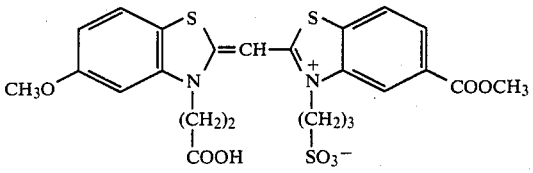
-continued
Sensitizers for Blue-Sensitive Emulsion
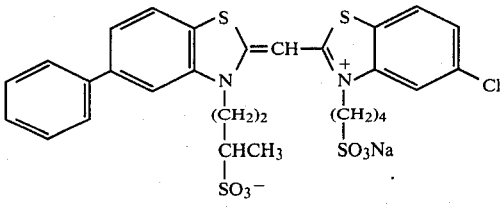
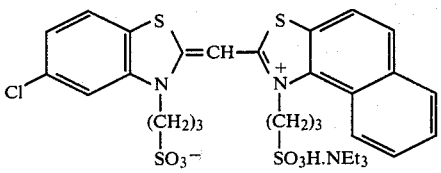
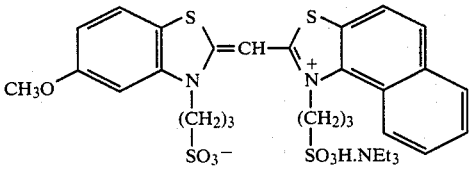
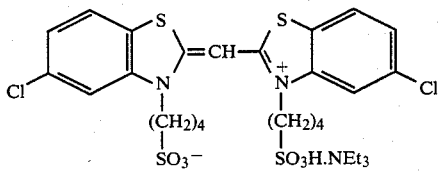
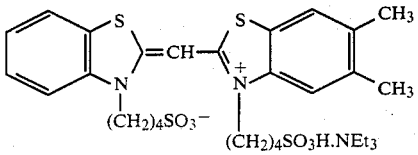
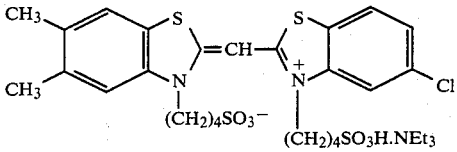
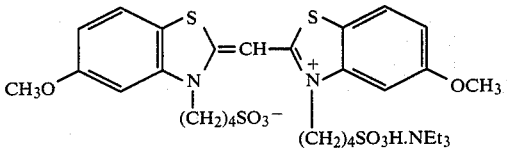
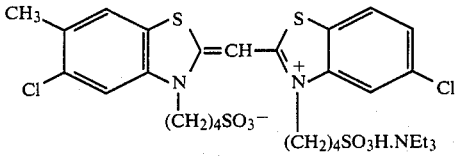

-continued
Sensitizers for Blue-Sensitive Emulsion
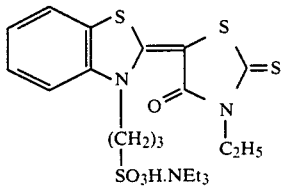
-continued
Sensitizers for Blue-Sensitive Emulsion
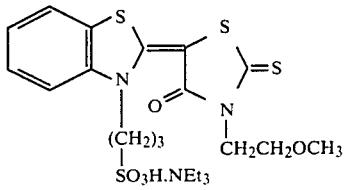
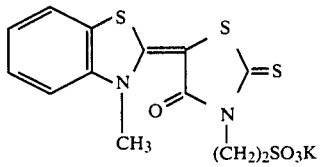
Sensitizers for Green-Sensitive Emulsion
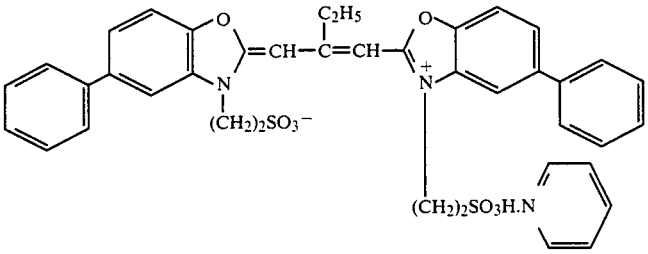
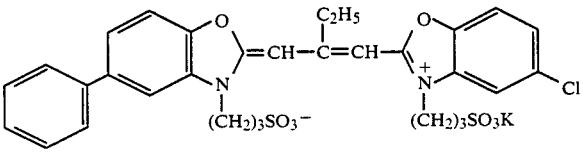
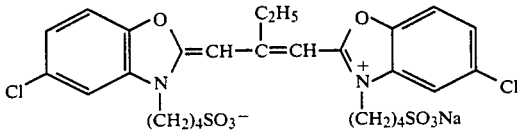
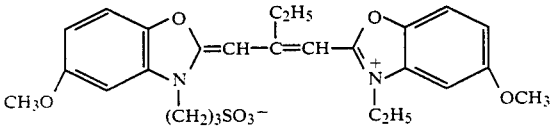
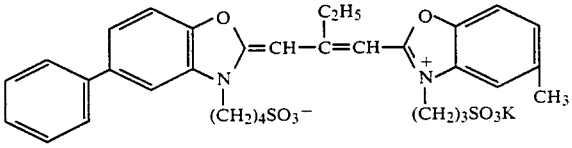
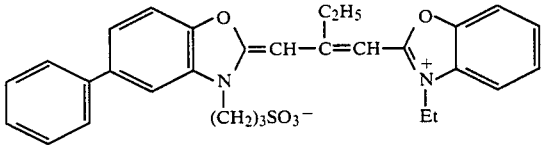
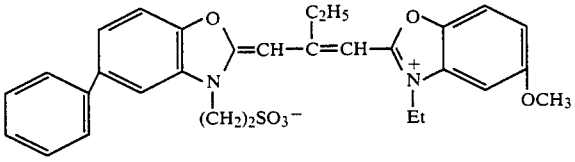
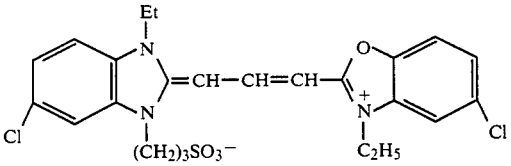
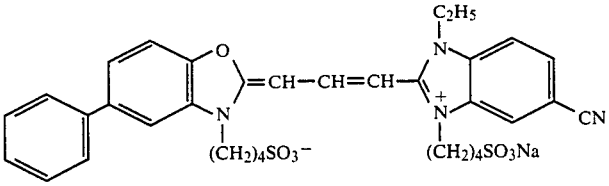
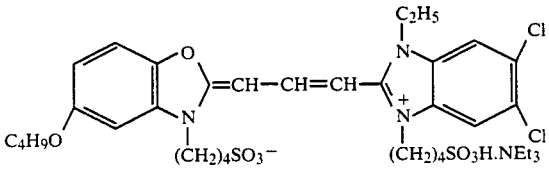
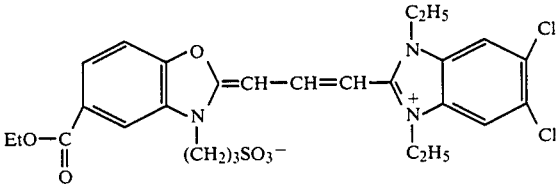

-continued
Sensitizers for Green-Sensitive Emulsion
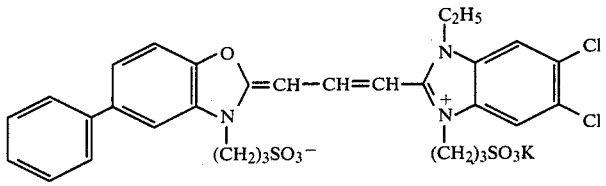
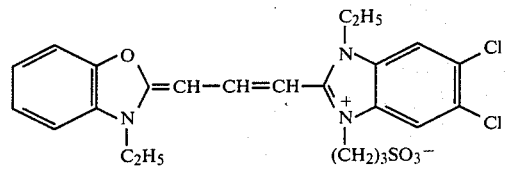
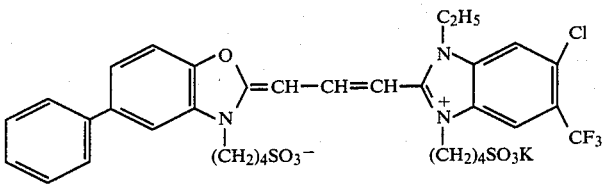
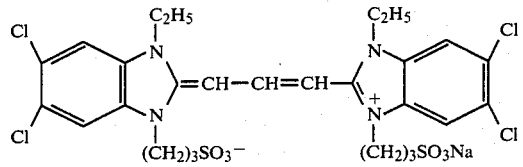
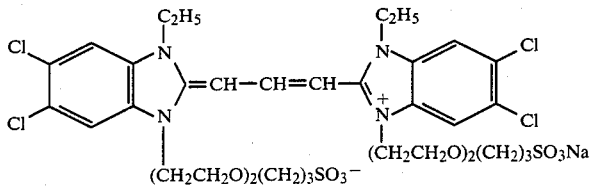
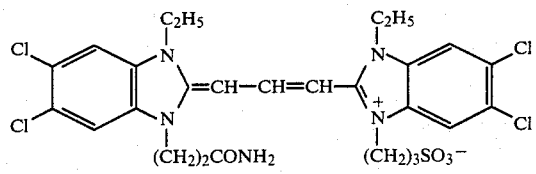
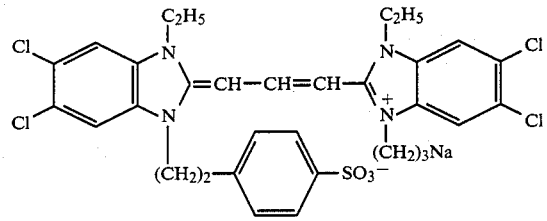
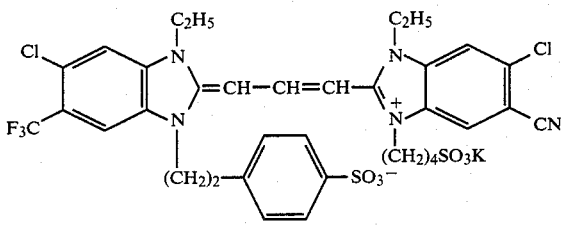
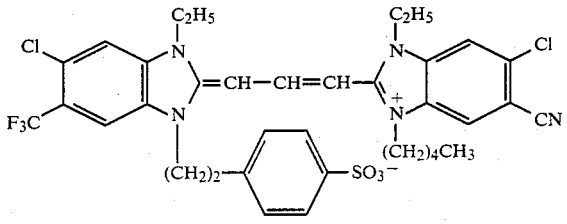
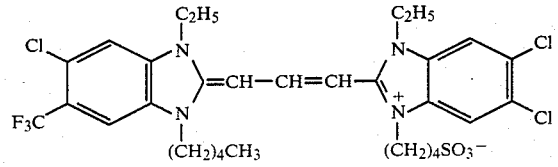
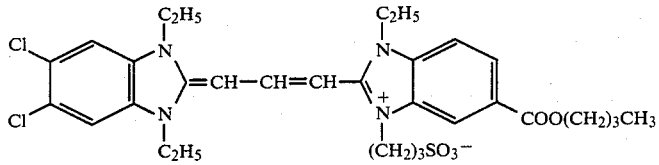
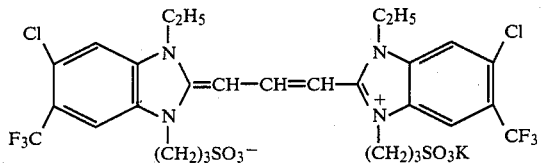
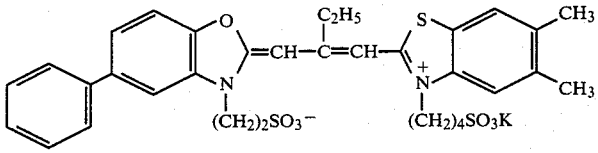
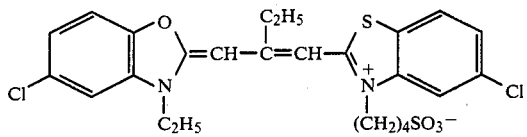
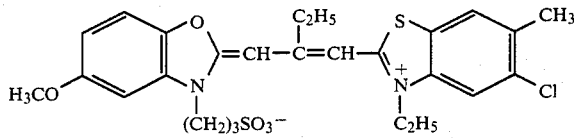

-continued
Sensitizers for Green-Sensitive Emulsion
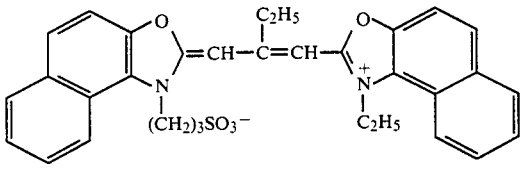
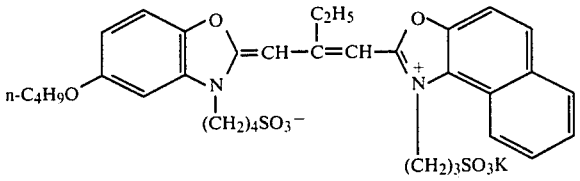
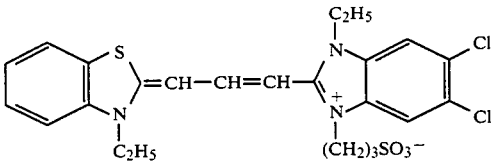
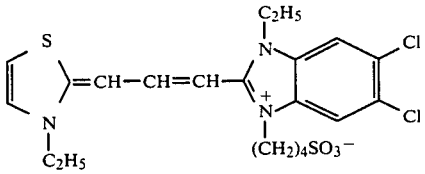
Sensitizers for Red-Sensitive Emulsion
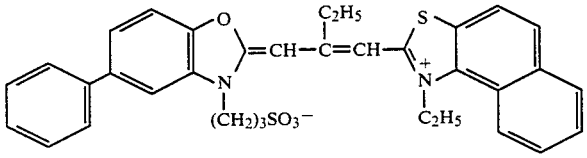
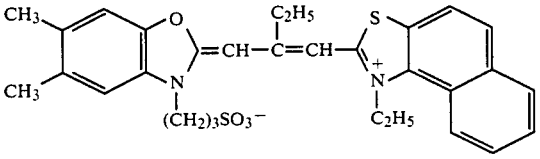
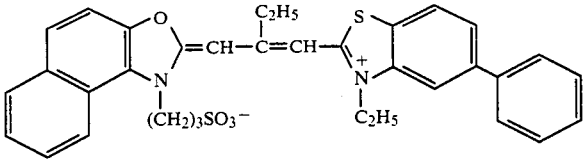
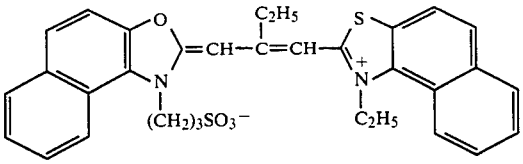
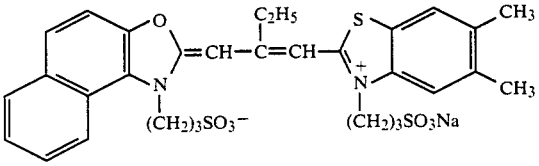
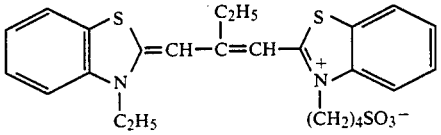
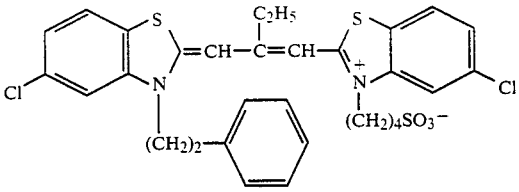
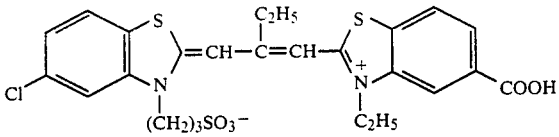
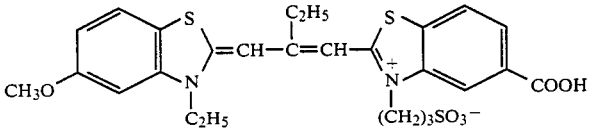
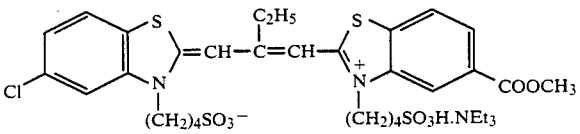
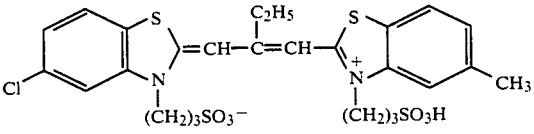
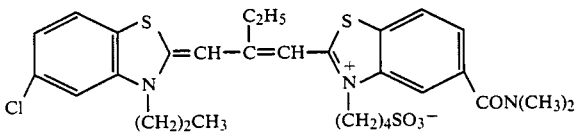
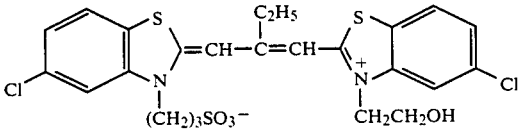

-continued

Sensitizers for Red-Sensitive Emulsion

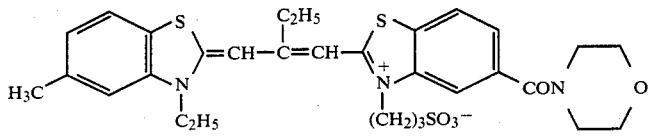

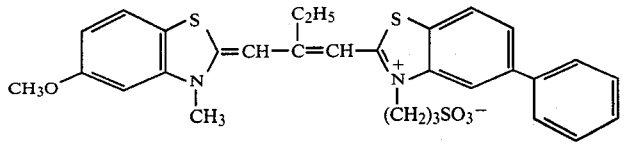

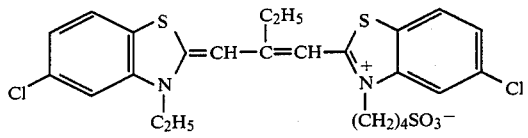

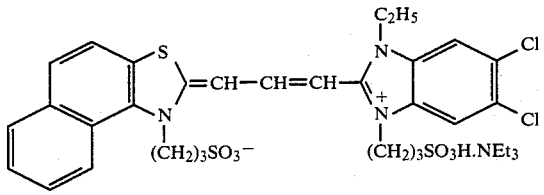

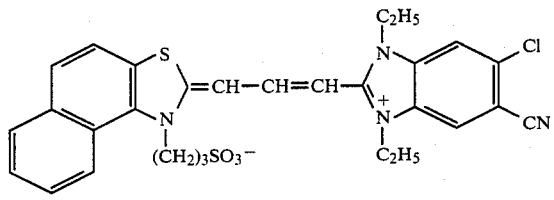

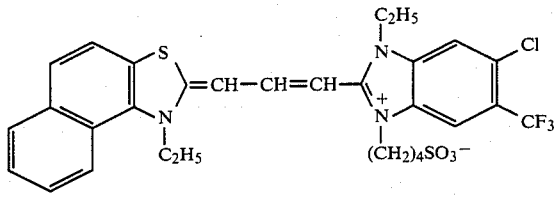

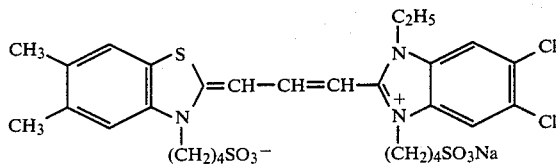

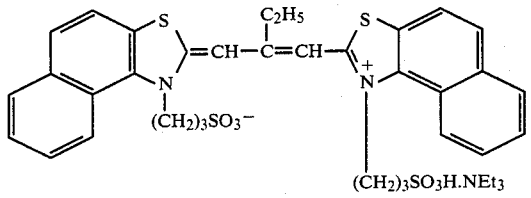

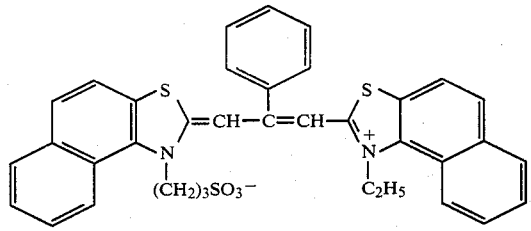

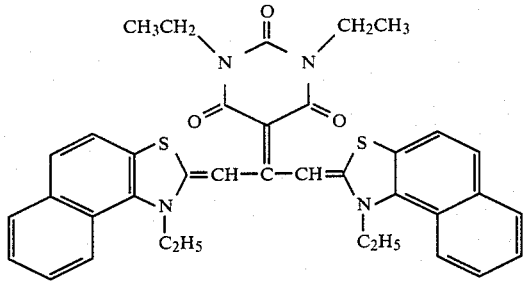

Some effect can be obtained by incorporating the diffusible DIR compound in one of the blue-sensitive layer, green-sensitive layer and red-sensitive layer but, in order to obtain better color reproduction, the compound is desirably incorporated in two or more of the layers. It may be incorporated in a silver halide-free layer or a light-insensitive layer as long as it substantially undergoes, upon color development, coupling reaction with the oxidation product of a color developing agent having diffused from another layer to release a coupling-off group.

In addition, one light-sensitive layer may be divided into two or more sub-layers, and the diffusible DIR compound may be incorporated in one or more of the sub-layers, while not being incorporated in the remaining sub-layers. In such case, the plural sub-layers may be different from each other in sensitivity (for example, so-called more sensitive sub-layer and less sensitive sub-layer) or may not be completely the same in light sensitivity.

When incorporated in a light-insensitive emulsion layer, the diffusible DIR compound is to be incorporated in an amount of 0.01 to 50 mol%, preferably 0.1 to 5 mol%, based on the amount of silver halide in its adjacent layer.

The compounds of the present invention capable of releasing a diffusible development inhibitor or its precursor upon coupling with a color developing agent are those represented by the following formula:

$J\text{-}(Y)_h$ (I)

wherein J represents a coupler component, h represents 1 or 2, and Y represents a group bound to the coupling position of coupler component J and to be eliminated by the reaction with the oxidation product of a color developing agent to form a development inhibitor or a development inhibitor-releasing compound (preferably having a diffusibility of 0.04 or more measured according to the method to be described hereinafter).

In the general formula (I), Y specifically represents the following general formulae (II) to (V):

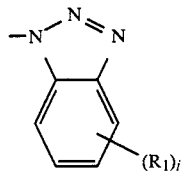
(II)

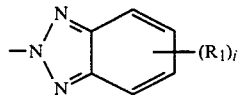
(II)

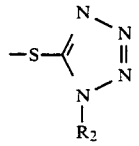
(IV)

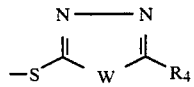
(V)

wherein W represents —S— or —N($R_3$)—, $R_1$, $R_2$, $R_3$ and $R_4$ each represents a substituent selected so as to adjust the diffusibility to 0.04 or more, and i represents 1 to 4.

Examples of the substituents to be selected are as follows. Examples of $R_1$ include $CH_3$ (provided that i=2), Br— (provided that i=1), —NHCOR′ (number of carbon atoms in R′: 3 to 7), —$NHSO_2R'$ (number of carbon atoms in R′: 4 to 8), —OR′ (number of carbon atoms in R′: 2 to 5), —R′ (number of carbon atoms in R′: 1 to 3),

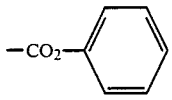

and —$CO_2R'$ (number of carbon atoms in R′: 2 to 6), with R′ representing a substituted or unsubstituted, straight chain, cyclic or branched chain aliphatic group.

Examples of $R_2$ include an ethyl group, a propyl group, a hydroxy-substituted phenyl group, an amino-substituted phenyl group, a sulfamoyl-substituted phenyl group, a carboxy-substituted phenyl group, a methoxycarbonyl-substituted phenyl group, a 3-methoxyphenyl group, —$(CH_2)_{2-3}$—COOR′ (number of carbon atoms in R′: 2 to 3),

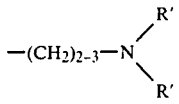

(two R's being the same or different and containing 2 to 3 carbon atoms), —$(CH_2)_2$—$OCH_3$, a 3-carbamoylphenyl group, and a 3-ureidophenyl group, with R′ being the same as defined with respect to $R_1$.

Examples of $R_3$ include a hydrogen atom and an alkyl group containing 1 to 4 carbon atoms, and examples of $R_4$ include an amino group, —NHCOR′ (number of carbon atoms in R′: 1 to 6),

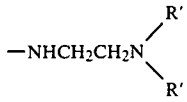

(R's may be the same or different and represent a methyl group or an ethyl group), an ethyl group, a propyl group, —$(CH_2)_{2-3}COOH$, and —$(CH_2)_{2-4}$-$SO_3H$.

Diffusibility of the development inhibitor is evaluated as follows.

A two-layered light-sensitive material composed of the layers of the following formulations was prepared on a transparent support (Sample B).

First Layer

Red-Sensitive Silver Halide Emulsion Layer

A gelatin coating solution containing a silver bromoiodide emulsion (silver iodide: 5 mol%; mean grain size: 0.04μ) rendered red-sensitive by using $6\times10^{-5}$ mol of Sensitizing Dye I used in Example 1 per mol of silver and 0.0015 mol of Coupler X per mol of silver was coated in a coated amount of silver of 1.8 g/m$^2$ (coating thickness: 2μ).

Coupler X

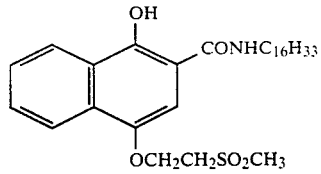

Second Layer

A gelatin layer containing the silver bromoiodide emulsion used for the first layer (having no red sensitivity) and polymethyl methacrylate particles (diameter: about 1.5μ) (coated silver amount: 2 g/m$^2$; coating thickness: 1.5μ).

In addition to the above-described compositions, the two layers contained a gelatin hardener and a surfactant.

A light-sensitive layer having the same constitution as that of Sample B except for not containing the silver bromoiodide emulsion in the second layer was prepared, which was referred to as Sample A.

The thus-obtained Samples A and B were exposed to red light through a wedge and processed in the same manner as in Example 1 described hereinafter except for conducting development for 2 minutes and 10 seconds. To the developing solution was added a development inhibitor to such degree that the density of Sample A was decreased to ½. The degree of reduction in density of Sample B was taken as a measure of diffusibility in the silver halide emulsion layer. Results are tabulated in Table 1.

TABLE 1

| Development Inhibitor | Amount Added to Developer (M) | Reduction of Density Sample A (%) | Reduction of Density Sample B (%) | Diffusibility (B/A) |
|---|---|---|---|---|
| 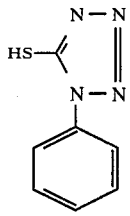 | $0.75 \times 10^{-4}$ | 50 | 10 | 0.2 |
| 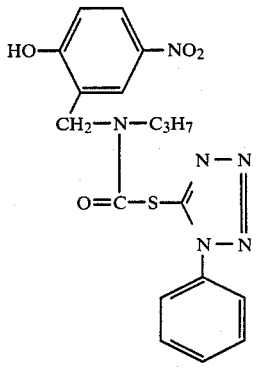 | $1 \times 10^{-4}$ | 50 | 25 | 0.5 |
| 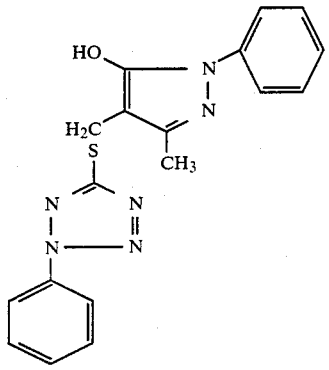 | $0.8 \times 10^{-4}$ | 48 | 20 | 0.42 |
| 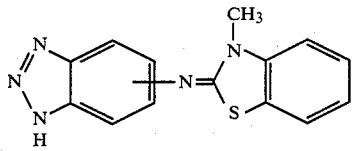 | $0.5 \times 10^{-4}$ | 50 | 15 | 0.3 |
| 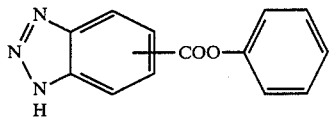 | $2 \times 10^{-4}$ | 52 | 37 | 0.74 |
| 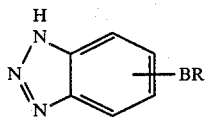 | $2.5 \times 10^{-4}$ | 51 | 45 | 0.9 |

In the general formula (I), Y further represents the following general formula (VI):

-TIME-INHIBIT (VI)

wherein TIME is a group which is bound to the coupling position of the coupler component and is to be cleaved by the reaction with a color developing agent and which, after being cleaved from the coupler component, releases the INHIBIT group under proper control, and INHIBIT represents a development inhibitor.

In the general formula (VI), preferable examples of the group of -TIME-INHIBIT are those represented by the following general formulae (VII) to (VIII):

(VII)

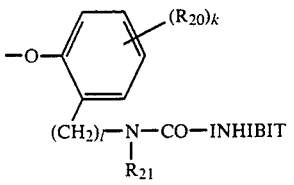

(VIII)

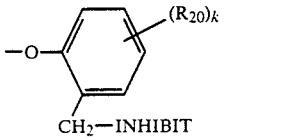

(IX)

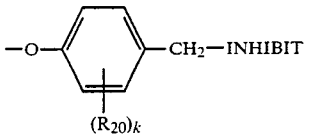

(X)

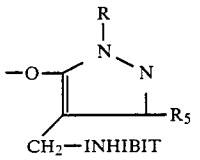

(XI)

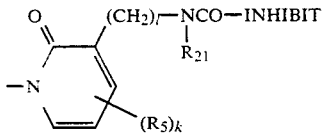

(XII)

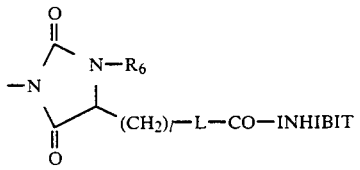

(XIII)

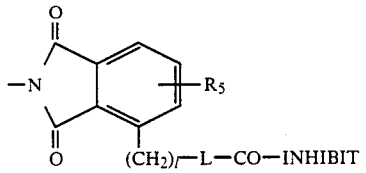

In the general formulae (VII) to (XIII), $R_5$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkanesulfonyl group.

In the general formulae (VII), (VIII), (IX), (XI) and (XIII), K represents 1 or 2.

In the general formulae (VII), (XI), (XII) and (XIII), l represents an integer of 0 to 2.

In the general formulae (VII), (X) and (XI), $R_6$ represents an alkyl group, an alkenyl group, an aralkyl group, a cycloalkyl group or an aryl group.

In the general formulae (XII) and (XIII), L represents an oxygen atom or

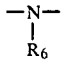

($R_6$ being the same as defined hereinbefore).

Preferable examples of INHIBIT are those represented by the general formulae (II), (III), (IV) and (V) (provided that $R_1$, $R_2$, $R_3$ and $R^4$ read as $R'_1$, $R'_2$, $R'_3$ and $R'_4$, respectively).

In the general formulae (II) and (III), $R'_1$ represents an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a hetero ring group, a cyano group, an alkylsulfonyl group or an aryloxycarbonylamino group, and i represents 1 or 2. When i represents 2, $R'_1$s may be the same or different, and the number of the total carbon atoms contained in i $R'_1$(s) is 0 to 32.

In the general formula (IV), $R'_3$ represents an alkyl group, an aryl group or a hetero ring group.

In the general formula (V), $R'_{18}$ represents a hydrogen atom, an alkyl group, an aryl group or a hetero ring group and $R'_4$ represents a hydrogen atom, an alkyl group, an aryl group, a halogen atom, an acylamino group, an alkoxycarbonylamino group, an aryloxycarbonylamino group, an alkanesulfonamide group, a cyano group, a hetero ring group, an alkylthio group or an amino group.

When $R'_1$, $R'_2$, $R'_3$ or $R'_4$ represents an alkyl group, the alkyl group may be substituted or unsubstituted, and may be chain-like or cyclic. Substituents include a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkanesulfonyl group, an arylsulfonyl group, an alkylthio group or an arylthio group.

When $R'_1$, $R'_2$, $R'_3$ or $R'_4$ represents an aryl group, it may be substituted by, for example, an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonylamino group, an alkoxycarbonylamino group, an acylamino group, a cyano group or a ureido group.

When $R'_1$, $R'_2$, $R'_3$ or $R'_4$ represents a hetero ring group, it represents a 5- or 6-membered monocyclic or fused ring system containing a nitrogen atom, oxygen atom or sulfur atom as a hetero atom, and is selected from among a pyridyl group, a quinolyl group, a furyl group, a benzothiazolyl group, an oxazolyl group, an imidazolyl group, a thiazolyl group, a triazolyl group, a benzotriazolyl group, an imido group, an oxazine groiup, etc. The hetero ring may be substituted by the substituent illustrated with respect to the above aryl group.

In the general formula (IV), $R'_2$ contains 1 to 32 carbon atoms.

In the general formula (V), $R'_3$ and $R'_4$ contain in all 1 to 32 carbon atoms.

When $R'_5$ and $R'_6$ represent alkyl groups, they may be substituted or unsubstituted and may be chain-like or cyclic. As the substituent, there are those illustrated with respect to the alkyl group represented by $R'_1$ to $R'_4$.

When $R'_5$ and $R'_6$ represent aryl groups, they may be substituted by, for example, those illustrated with respect to the aryl group represented by $R'_1$ to $R'_4$.

Yellow image-forming coupler residues represented by J in the general formula (I) include pivaloylacetanilide type, benzoylacetanilide type, malondiester type, malondiamide type, dibenzoylmethane type, benzothiazolylacetamide type, malonestermonoamide type, benzothiazolylacetate type, benzoxazolylacetamide type, benzoxazolylacetate type, malondiester type, benzimidazolylacetamide type or benzimidazolylacetate type coupler residues, coupler residues derived from hetero ring-substituted acetamides or hetero ring-substituted acetates described in U.S. Pat. No. 3,841,880, coupler residues derived from acylacetamides described in U.S. Pat. No. 3,770,446, British Pat. No. 1,459,171, West German (OLS) No. 2,503,099, Japanese Patent Application (OPI) No. 139738/75 or *Research Disclosure,* 15737, and hetero ring type coupler residues described in U.S. Pat. No. 4,046,574.

Preferred magenta color image-forming coupler residues represented by J include coupler residues with a 5-oxo-2-pyrazoline nucleus, pyrazolo[1,5-a]benzimidazole nucleus or cyanoacetophenone type coupler residues.

Preferred cyan color image-forming coupler residues represented by J include coupler residues with a phenol nucleus or an α-naphthol nucleus.

Further, even when the coupler does not substantially form a dye after releasing a development inhibitor by coupling with an oxidation product of a developing agent, it exhibits the same effects as a DIR coupler. Coupler residues of this type represented by J are described in U.S. Pat. Nos. 4,052,213, 4,088,491, 3,632,345, 3,958,993 or 3,961,959.

In the general formula (I), J preferably represents the following general formulae (XIV), (XV), (XVI), (XVII), (XVIII), (XIX), (XX) and (XXI):

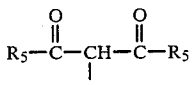

(XIV)

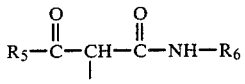

(XV)

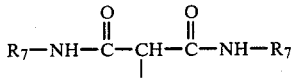

(XVI)

-continued

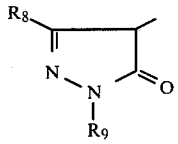

(XVII)

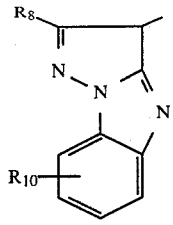

(XVIII)

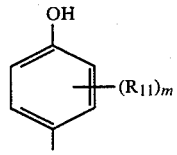

(XIX)

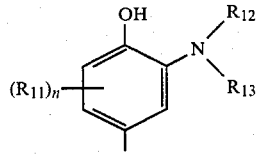

(XX)

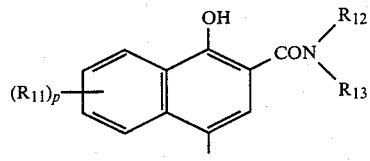

(XXI)

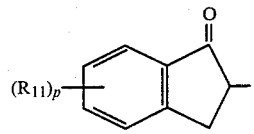

(XXII)

In these formulae, $R_5$ represents an aliphatic group, an aromatic group, an alkoxy group or a hetero ring group, $R_6$ and $R_7$ each represents an aromatic group, an aliphatic group or a hetero ring.

The aliphatic group represented by $R_5$ preferably contains 1 to 22 carbon atoms, and may be substituted or unsubstituted and may be chain-like or cyclic. Preferable substituents of the alkyl group include an alkoxy group, an aryloxy group, an amino group, an acylamino group, a halogen atom, etc., which may themselves be further substituted.

Specific examples of the useful aliphatic group represented by $R_5$, $R_6$ and $R_7$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl gorup, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

Where $R_5$, $R_6$ or $R_7$ represents an aromatic group (particularly a phenyl group), the aromatic group may be substituted. Such aromatic groups as phenyl groups may be substituted by an alkyl group containing up to 32 carbon atoms, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group, etc. The alkyl moiety may be interrupted by an aromatic group such as a phenylene group. The phenyl group may also be substituted by an aryloxy group, an aryloxycarbonyl group, an arylcarbamoyl group, an arylamido group, an arylsulfamoyl group, an arylsulfonamido group, an arylureido group or the like. The aryl moieties in these substituents may further be substituted by one or more alkyl groups containing in all 1 to 22 carbon atoms.

The phenyl group represented by $R_5$, $R_6$ or $R_7$ may further be substituted by an amino group including those substituted by lower alkyl group or groups containing 1 to 6 carbon atoms, a hydroxy group, a carboxy group, a sulfo group, a nitro group, a cyano group, a thiocyano group or a halogen atom.

In addition, $R_5$, $R_6$ or $R_7$ may represent a fused ring system wherein a phenyl group is fused with another ring, such as a quinolyl group, an isoquinolyl group, a chromanyl group, a coumaranyl group, a tetrahydronaphthyl group, etc. These substituents themselves may further have substituents.

Where $R_5$ represents an alkoxy group, the alkyl moiety is a straight or branched chain alkyl group containing 1 to 40, preferably 1 to 22, carbon atoms, an alkenyl group, a cyclic alkyl group or a cyclic alkenyl group, which may be substituted by a halogen atom, an aryl group, an alkoxy group, etc.

Where $R_5$, $R_6$ or $R_7$ represents a hetero ring group, the hetero ring group is bound to the carbon atom of carbonyl group of acyl group in the α-acylacetanilide or to the nitrogen atom of the amido group via one carbon atom forming the ring. Examples of such hetero ring include thiophene, furan, pyrrole, pyrazole, pyridine, pyrazine, pyrimidine, pyridazine, indolizine, imidazole, thiazole, oxazole, triazine, thiadiazine, oxazine, etc. These may further have a substituent or substituents in the ring.

In the general formula (XVII), $R_9$ represents a straight or branched alkyl group containing 1 to 40, preferably 1 to 22, carbon atoms (e.g., a methyl gorup, an isopropyl group, a tert-butyl group, a hexyl group, a dodecyl group, etc.), an alkenyl group (e.g., an allyl group), a cyclic group (e.g., a cyclopentyl group, a cyclohexyl group, a norbornyl group, etc.), an aralkyl group (e.g., a benzyl group, a β-phenylethyl group, etc.), and a cyclic alkenyl group (e.g., a cyclopentenyl group, a cyclohexenyl group, etc.). These may be substituted by a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a hetero ring group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

Further, $R_9$ may represent an aryl group (e.g., a phenyl group, an α- or β-naphthyl group, etc.). The aryl group may have one or more substituents such as an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a hetero ring group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. Preferable examples of $R_9$ are phenyl groups substituted at least in one o-position by an alkyl group, an alkoxy group, a halogen atom or the like. These are useful because couplers remaining in the film coatings form less color due to light or heat.

Still further, $R_9$ may represent a hetero ring group (e.g., 5- or 6-membered monocyclic or fused hetero ring systems containing a nitrogen atom, oxygen atom or sulfur atom as a hetero atom, such as a pyridyl group, a quinolyl group, a furyl group, a benzothiazolyl group, an oxazolyl group, an imidazolyl group, a naphthoxazolyl group, etc.), hetero ring groups substituted by the substituents illustrated hereinbefore with respect to the aryl group, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above formulae, $R_8$ represents a hydrogen atom, a straight or branched chain alkyl group containing 1 to 40, preferably 1 to 22, carbon atoms, an alkenyl group, a cyclic alkyl group, an aralkyl group or a cyclic alkenyl group (these may have the substituents illustrated hereinbefore with respect to $R_9$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxy group, an acylamino group (e.g., an acetylamino group, a 3-(2,4-ditert-amylphenoxy)acetamidobenzamido group, etc.), a diacylamino group, an N-alkylacylamino group (e.g., an N-methylpropionamido group), an N-arylacylamino group (e.g., an N-phenylacetamido group), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecaneanilino group, etc.), a dialkylamino group (e.g., a dibenzylamino group), an alkylamino group (e.g., an n-butylamino group, a methylamino group, a cyclohexylamino group, etc.), a cycloamino group (e.g., a piperidino group, a pyrrolidino group, etc.), a hetero ring amino group (e.g., a 4-pyridylamino group, a 2-benzoxazolylamino group, etc.), an alkylcarbonyl group (e.g., a methylcarbonyl group), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, a mercapto group, a halogen atom or a sulfo group.

$R_{10}$ represents a hydrogen atom or a straight or branched chain alkyl group containing 1 to 32, preferably 1 to 22, carbon atoms, an alkenyl group, a cyclic alkyl group, an aralkyl group or a cyclic alkenyl group, which may have a substituent or substituents illustrated with $R_9$ hereinbefore.

$R_{10}$ may represent an aryl group or a hetero ring group which may optionally have a substituent or substituents illustrated hereinbefore with respect to $R_9$.

Further, $R_{10}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

$R_{11}$, $R_{12}$ and $R_{13}$ represent groups used for usual 4-equivalent phenol or α-naphthol couplers. Specific examples of $R_{11}$ include a hydrogen atom, a halogen atom, an aliphatic hydrocarbon residue, an acylamino group, —O—$R_{14}$ and —S—$R_{14}$ ($R_{14}$: aliphatic hydrocarbon residue). Where two or more $R_{11}$s exist in the same molecule, they may be the same or different. The aliphatic hydrocarbon residues include substituted ones. Specific examples of $R_{12}$ and $R_{13}$ include an aliphatic hydrocarbon residue, an aryl group, and a hetero ring residue, which may be further substituted. One of them may be a hydrogen atom. In addition, $R_{12}$ and $R_{13}$ may be bound to each other to form a nitrogen-containing hetero ring nucleus. m represents an integer of 1 to 4. n represents an integer of 1 to 3, and p represents an integer of 1 to 5. The aliphatic hydrocarbon residue may be saturated or unsaturated and may be straight, branched or cyclic. Preferable examples thereof include an alkyl group (e.g., a methyl group, an ethyl group, a propyl group, an isopropyl group, a butyl group, a t-butyl group, an isobutyl group, a dodecyl group, an octadecyl group, a cyclobutyl group, a cyclohexyl group, etc.), an alkenyl group (e.g., an allyl group, an octenyl group, etc.), etc. Examples of the aryl group include a phenyl group, a naphthyl group, etc., and the hetero ring residue is typically exemplified by a pyridinyl group, a quinolyl group, a thienyl group, a piperidyl group, an imidazolyl group, etc. As the substituents to be introduced into these hydrocarbon residues, aryl groups, and hetero ring residues, there are illustrated a halogen atom, a nitro group, a hydroxy group, a carboxy group, an amino group, a substituted amino group, a sulfo group, an alkyl group, an alkenyl group, an aryl group, a hetero ring group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

$R_5$, $R_6$, $R_7$, $R_8$, $R_9$, $R_{10}$, $R_{11}$, $R_{12}$ and $R_{13}$ in the couplers represented by the general formulae (XIV) to (XXII) may be bound to each other or may be a divalent group to form symmetric or asymmetric complex couplers.

Preferable examples of diffusible DIR compounds to be used in the present invention include the following compounds:

D-1

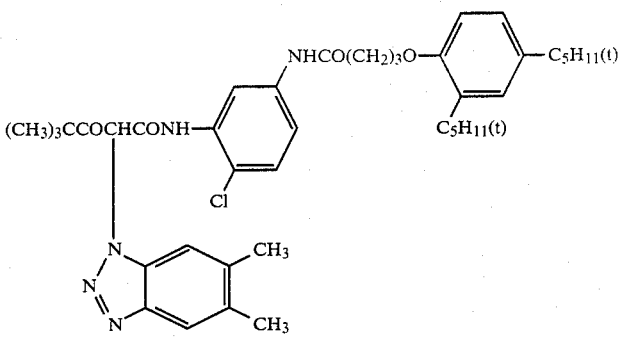

D-2

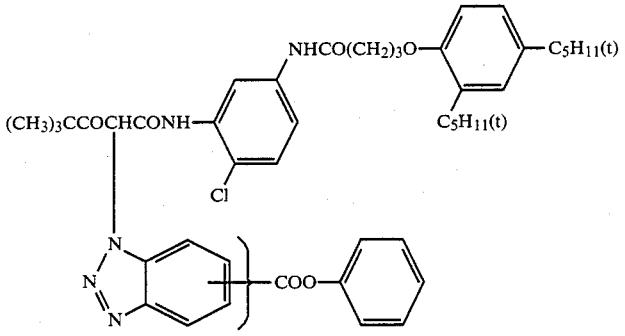

-continued
D-3
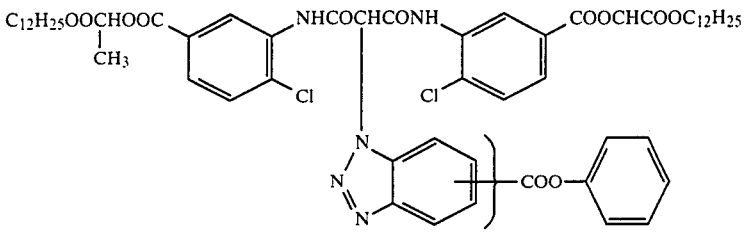
D-4
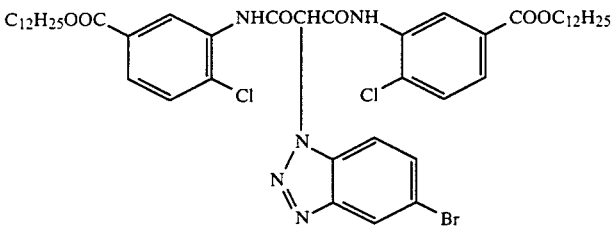
D-5
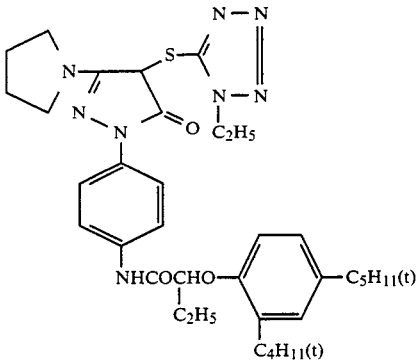
D-6
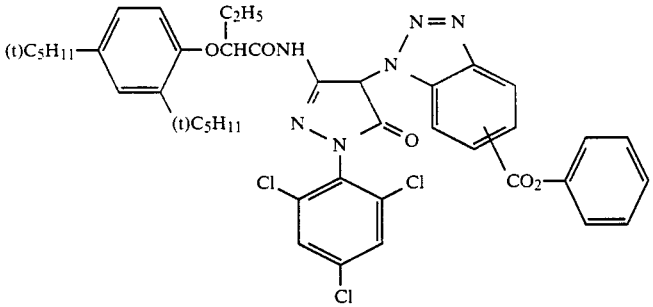
D-7
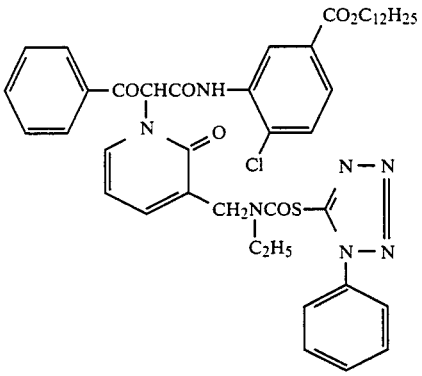
D-8
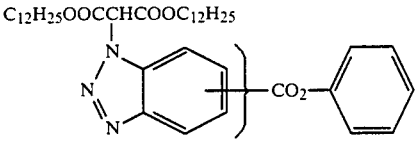

-continued
D-9
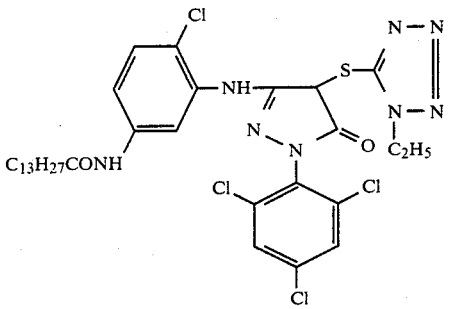
D-10
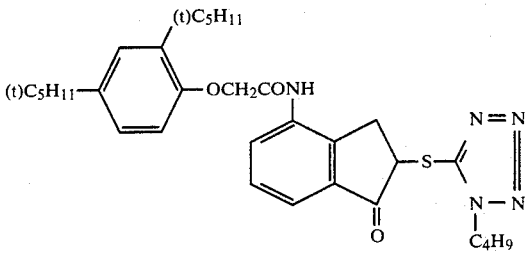
D-11
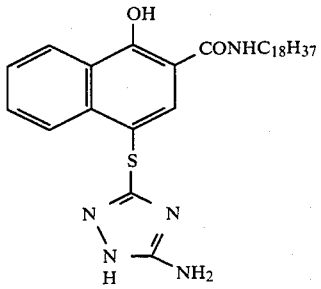
D-12
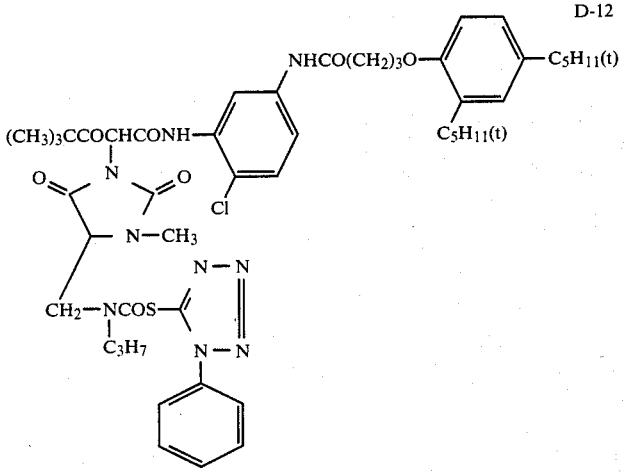
D-13
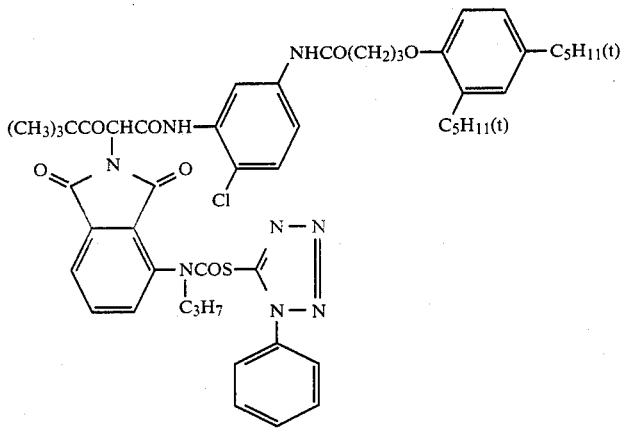
D-14
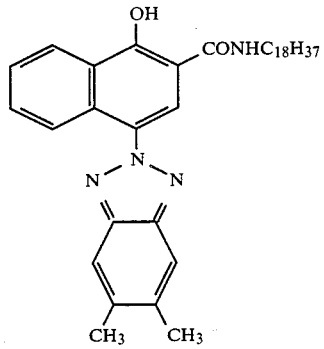
D-15
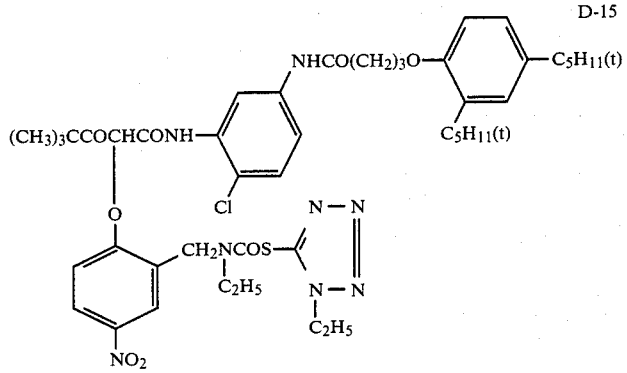

-continued
D-16
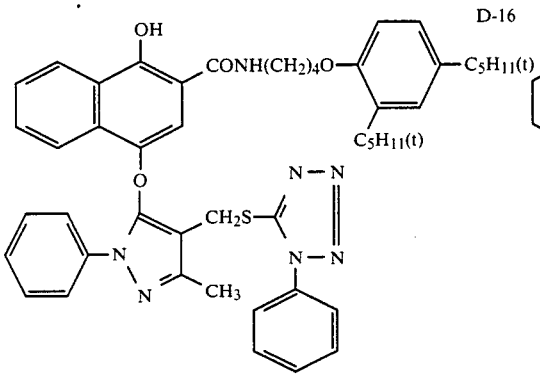
D-17
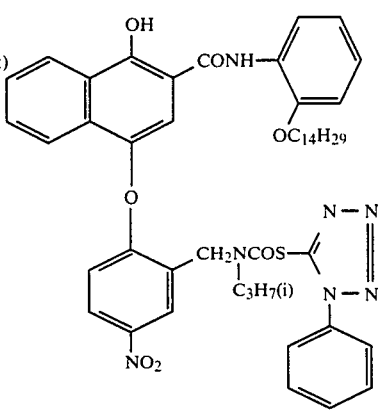
D-18
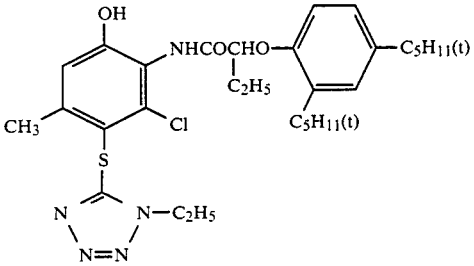
D-19
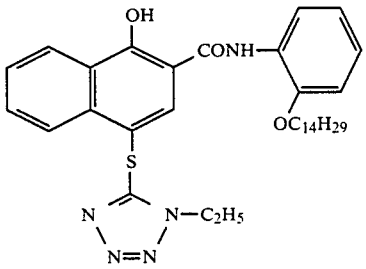
D-20
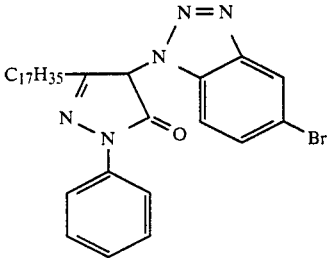
D-21
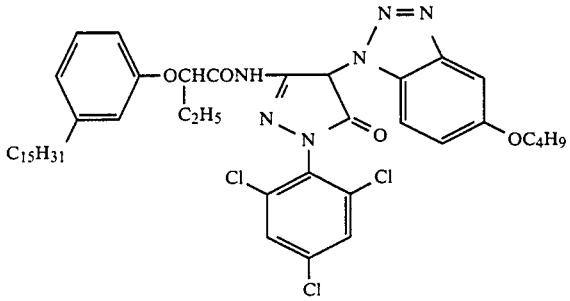
D-22
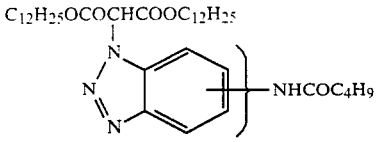
D-23
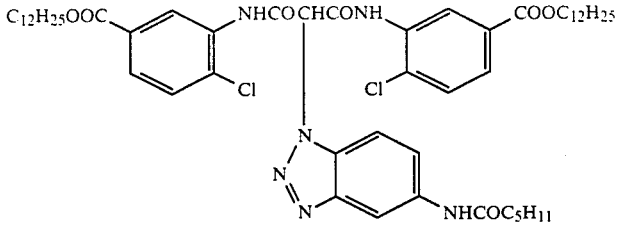
D-24
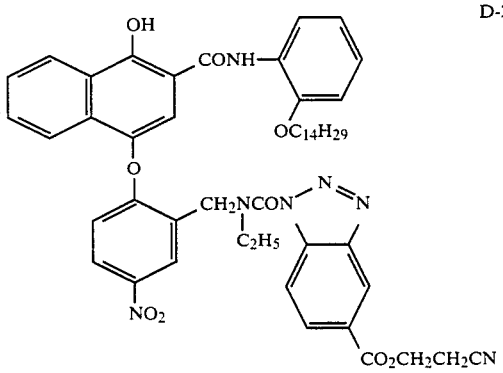
D-25
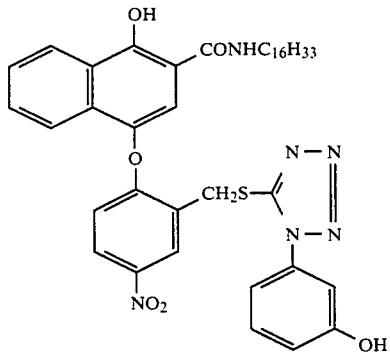

-continued
D-26
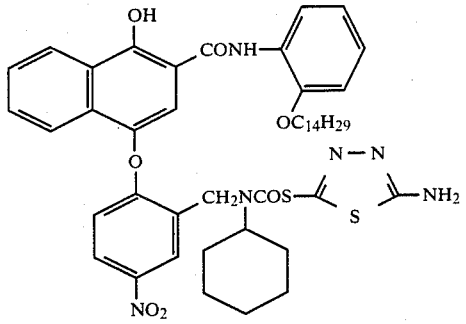
D-27
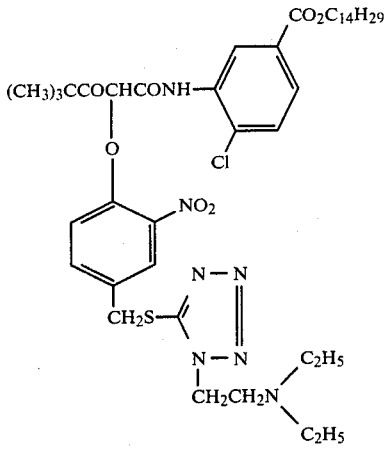
D-28
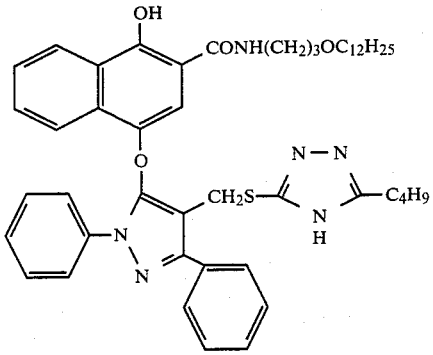
D-29
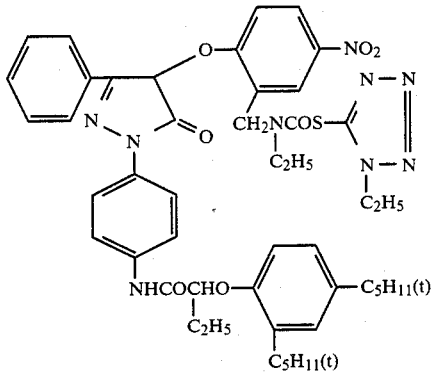
D-30
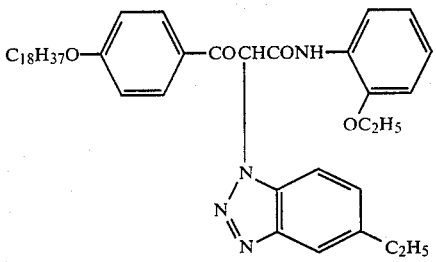
D-31
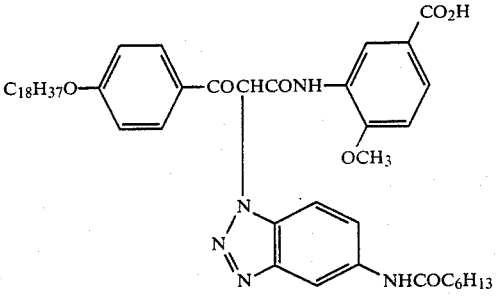
D-32
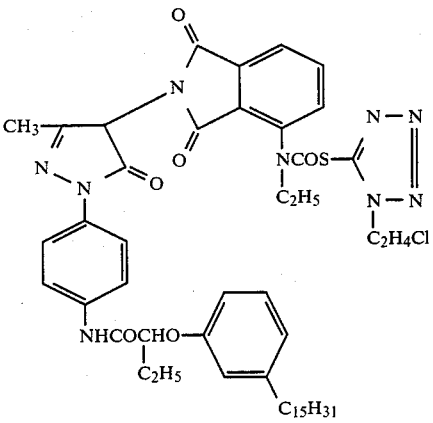
D-33
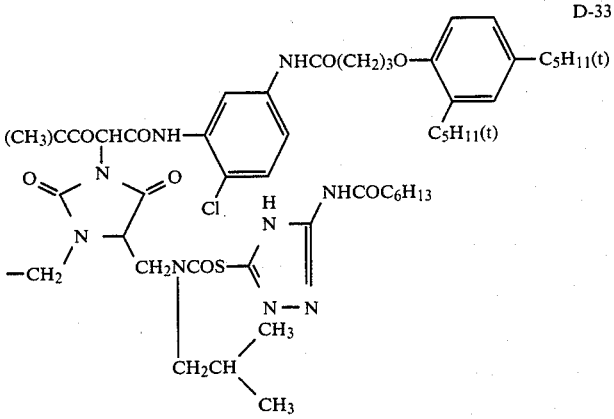

-continued
D-34
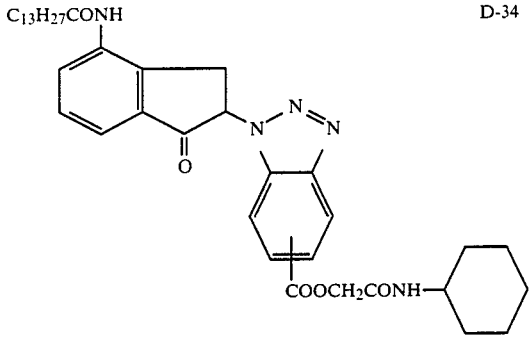
D-35
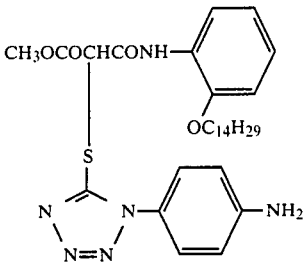
D-36
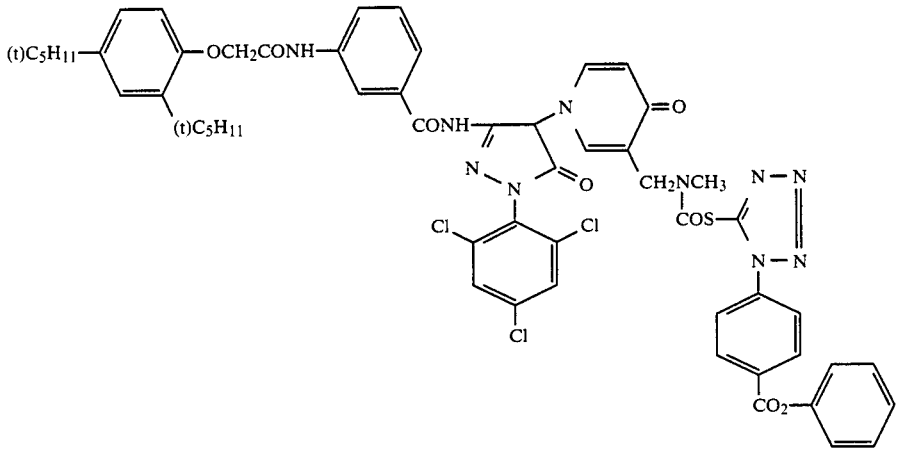
D-37
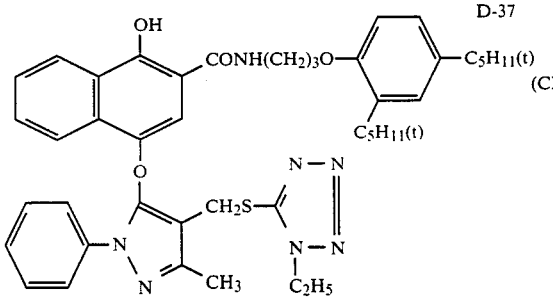
D-38
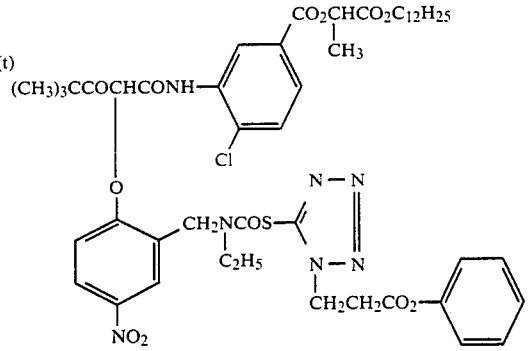
D-39
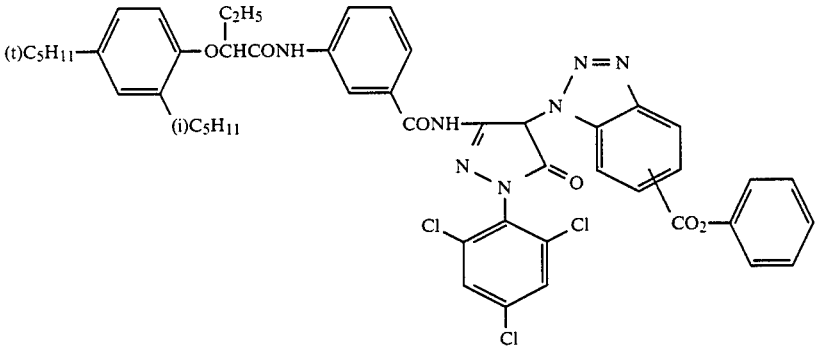

-continued

D-40

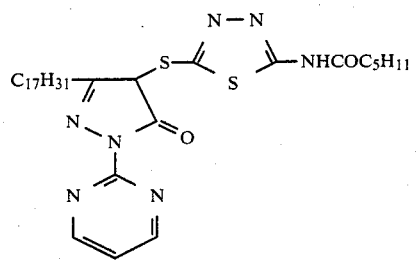

D-41

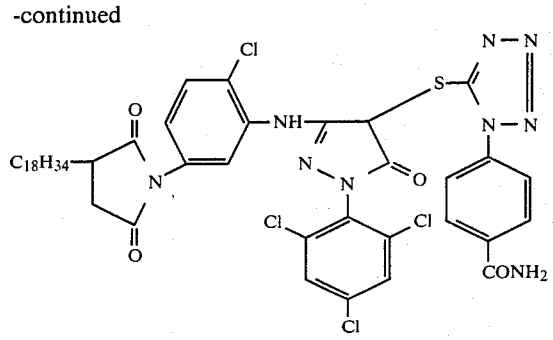

D-42

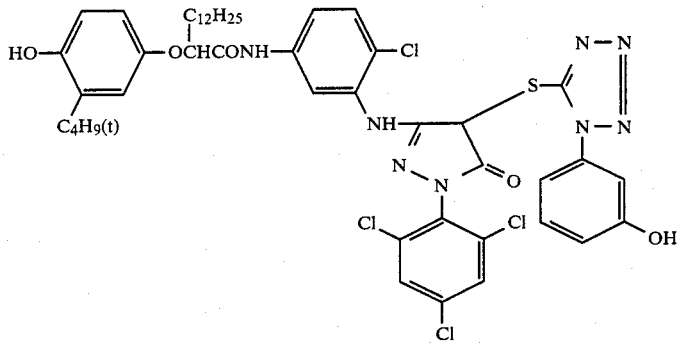

D-43

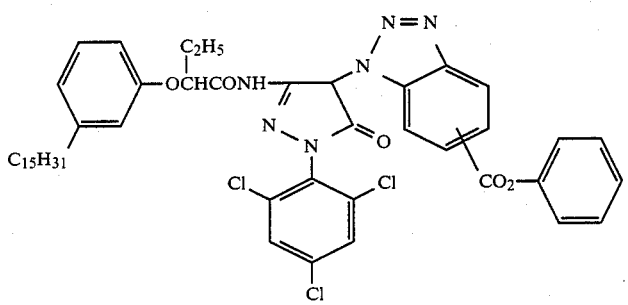

D-44

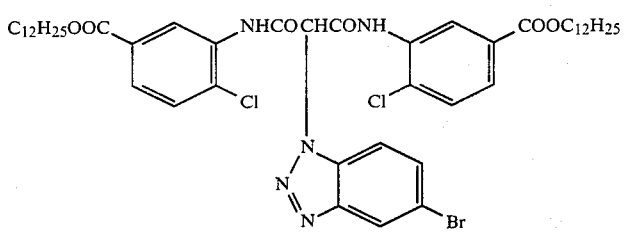

D-45

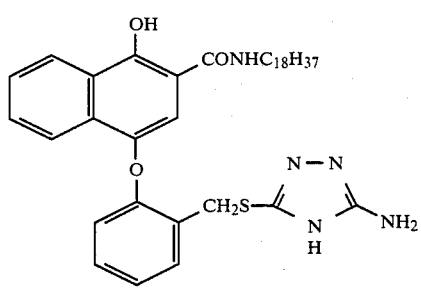

These compounds of the present invention can be easily synthesized according to the processes described in U.S. Pat. Nos. 4,234,678, 3,227,554, 3,617,291, 3,958,993, 4,149,886, 3,933,500, Japanese Patent Application (OPI) Nos. 56837/82 and 13239/76, British Pat. Nos. 2,072,363 and 2,070,266, *Research Disclosure,* December 1981, No. 21228, etc.

Introduction of the couplers into silver halide emulsion layers is conducted in a known manner, for example, according to the method described in U.S. Pat. No. 2,322,027. For example, the couplers are dissolved in an alkyl phthalate (e.g., dibutyl phthalate, dioctytl phthalate, etc.), a phosphoric ester (e.g., diphenyl phosphate, triphenyl phosphate, tricresyl phosphate, dioctylbutyl phosphate, etc.), citric ester (e.g., tributyl acetylcitrate), a benzoic ester (e.g., octyl benzoate), an alkylamide (e.g., diethyllaurylamide), fatty acid ester (e.g., dibutoxyethyl succinate, dioctyl azelate, etc.), a trimesic acid ester (e.g., tributyl trimesate) or an organic solvent having a boiling point of about 30° to 150° C. (e.g., ethyl acetate, butyl acetate or like lower alkyl acetate, ethyl propionate, sec-butyl alcohol, methyl isobutyl ketone, β-ethoxyethyl acetate, methyl Cellosolve acetate, etc.), and dispersed in a hydrophilic colloid. The above-described high-boiling organic solvents and the low-boiling organic solvents may be used in combination. In addition, a dispersing method using a polymer as described in Japanese Patent Publication No. 39853/76 and Japanese Patent Application (OPI) No. 59943/76 can be employed.

Couplers with an acid group such as a carboxylic acid or sulfonic acid are introduced into a hydrophilic colloid as an alkaline aqueous solution.

The high-boiling organic solvents are described, for example, in U.S. Pat. Nos. 2,322,027, 2,533,514, 2,835,579, Japanese Patent Publication No. 23233/71, U.S. Pat. No. 3,287,134, British Pat. No. 958,441, Japanese Patent Application (OPI) No. 1031/72, British Pat. No. 1,222,753, U.S. Pat. No. 3,936,303, Japanese Patent Application (OPI) Nos. 26037/76 and 82087/75, U.S. Pat. Nos. 2,353,262, 2,852,383, 3,554,755, 3,676,137, 3,676,142, 3,700,454, 3,748,141, 3,837,863, West German Patent Application (OLS) No. 2,538,889, Japanese Patent Application (OPI) Nos. 27921/76, 27922/76, 26035/76, 26036/76, 62632/75, Japanese Patent Publication No. 29461/74, U.S. Pat. Nos. 3,936,303, 3,748,141 Japanese Patent Application No. 1521/78, etc.

As a binder or protective colloid for the photographic emulsion, gelatin is advantageously used. However, other hydrophilic colloids can be used as well. For example, proteins such as gelatin derivatives, graft polymers between gelatin and other high polymer, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic substances such as homopolymers or copolymers (e.g., polyvinyl alcohol, partially acetallized polyvinyl alcohol, poly-N-vinylpyrrolidone, polyacrylic acid, polymethacrylic acid, polyacrylamide, polyvinylimidazole, polyvinyl pyrazole, etc.) can be used.

As gelatin, acid-processed gelatin or enzyme-processed gelatin as described in *Bull. Soc. Sci. Phot. Japan*, No. 16, p. 30 (1966) may be used as well as lime-processed gelatin, and a gelatin hydrolyzate or an enzyme-decomposed product can be used. As the gelatin derivatives, those obtained by reacting gelatin with, for example, acid halides, acid anhydrides, isocyanates, bromoacetic acid, alkanesulfones, vinylsulfonamides, maleinimide compounds, polyalkylene oxides, epoxy compounds, or the like can be used. Specific examples thereof are described in U.S. Pat. Nos. 2,614,928, 3,132,945, 3,186,846, 3,312,553, British Pat. Nos. 861,414, 1,033,189, 1,005,784, Japanese Patent Publication No. 26845/67, etc.

As the aforesaid gelatin graft polymers, high molecular weight grafted products of gelatin prepared by, for example, grafting to gelatin a homopolymer or copolymer of vinyl monomer such as acrylic acid, methacrylic acid, ester or amide thereof, acrylonitrile, styrene, or the like can be used. In particular, graft polymers between gelatin and a polymer having some compatibility with gelatin such as a polymer of acrylic acid, methacrylic acid, acrylonitrile, methacrylonitrile, hydroxyalkyl methacrylate or the like are preferable. Examples of these are described in U.S. Pat. Nos. 2,763,625, 2,831,767, 2,956,884, etc.

Typical synthetic high molecular substances are those described in, for example, West German (OLS) No. 2,312,708, U.S. Pat. Nos. 3,620,751, 3,879,205, and Japanese Patent Publication No. 7561/68.

In a photographic emulsion layer of photographic light-sensitive material of the present invention, any of silver bromide, silver bromoiodide, silver chlorobromoiodide, silver chlorobromide, and silver chloride may be used as a silver halide. Preferable silver halide is silver bromoiodide containing up to 15 mol%, particularly preferably 2 to 12 mol%, silver iodide. Silver halide grains in the photographic emulsion are not particularly limited as to mean particle size (particle diameter with respect to spherical or approximately sperical particles, and edge length with cubic particles; presented in terms of an average based on projected area), with particle size of 3μ or less being preferable. Particle size distribution can be either narrow or broad.

Silver halide particles may be in a regular crystal form such as cubic or octahedral form, in an irregular crystal form such as spherical or platy form, or in a mixed form thereof, or may comprise a mixture of particles in different forms.

The silver halide grains may have an inner portion and a surface layer different from, or the same as, each other in phase composition. In addition, silver halide grains of the type forming latent image mainly on the surface thereof and grains of the type forming latent image within them may be used.

The photographic emulsion to be used in the present invention can be prepared by the processes described in P. Glafkides, *Chimie et Physique Photographique* (published by Paul Montel in 1967), G. F. Duffin, *Photographic Emulsion Chemistry* (The Focal Press, 1966), V. L. Zelikman et al., *Making and Coating Photographic Emulsion* (The Focal Press, 1964), etc. That is, any of an acidic process, a neutral process and an ammoniacal process can be used. As a manner of reacting a soluble silver salt with a soluble halide salt, any of one side-mixing, simultaneous mixing, and their combination may be employed.

A process of forming grains in the presence of excess silver ion (called reverse mixing process) can be employed as well. As one type of the simultaneous mixing, a process called controlled double jet process wherein the pAg in a liquid phase in which silver halide is formed is kept constant can be employed. This process provides a silver halide emulsion containing silver halide grains having an approximately uniform particle size.

Two or more silver halide emulsions having been separately prepared may be mixed to use.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be allowed to coexist.

As the means for removing soluble salts from the emulsion after forming precipitates or physical ripening, a noodle washing method of gelling gelatin or a flocculation method utilizing an inorganic salt, an anionic surfactant, an anionic polymer (e.g., polystyrenesulfonic acid) or a gelatin derivative (e.g., acylated gelatin, carbamoylated gelatin, etc.) may be employed.

The silver halide emulsion is usually chemically sensitized. Chemical sensitization is conducted, for example, according to the processes described in *Die Grundlagen der Photographischen Prozesse mit Silberhalogeniden* (Akademische Verlagsgesellschaft, 1968), pp. 675–734.

That is, sulfur sensitization using active gelatin or sulfur-containing compounds capable of reacting with silver (e.g., thiosulfates, thioureas, mercapto compounds, rhodanines, etc.); reduction sensitization using reductive substances (e.g., stannous salts, amines, hydrazine derivatives, formamidinesulfinic acids, silane compounds, etc.); and noble metal sensitization using noble metal compounds (e.g., gold complex salts, complexes of the group VIII metals such as Pt, Ir, Pd, etc.) can be employed alone or in combination.

Specific examples thereof are described in U.S. Pat. Nos. 1,574,944, 2,410,689, 2,278,947, 2,728,668, 3,656,955, etc., as to sulfur sensitization, U.S. Pat. Nos. 2,983,609, 2,419,974, 4,054,458, etc., as to reduction sensitization, and U.S. Pat. Nos. 2,399,083, 2,448,060, British Pat. No. 618,061, etc., as to noble metal sensitization.

Various compounds may be added to the photographic emulsion to be used in the present invention for the purpose of preventing fogging of light-sensitive material during production steps, storage or photographic processing or for stabilizing photographic properties. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); hetero ring-containing mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines; hetero ring-containing mercapto compounds described above having a water-soluble group such as a carboxy group or a sulfo group; thioketo compounds (e.g., oxazolinethione); azaindenes (e.g., tetraazaindenes (particularly 4-hydroxy-substituted (1,3,3a,7)tetraazaindenes); benzenethiosulfonic acids; benzenesulfinic acids; etc., can be added.

As to more specific examples and manners of using them, reference to, for example, U.S. Pat. Nos. 3,954,474, 3,982,947, 4,021,248, Japanese Patent Publication No. 28660/77, etc., can be made.

The photographic light-sensitive material of the present invention may contain in its photographic emulsion layer or other hydrophilic layers various surfactants for various purposes such as improvement of coating properties, antistatic properties, slipping properties, emulsion dispersibility, anti-adhesion properties, and photographic properties (for example, development acceleration, realization of contrasty tone, sensitization, etc.).

For example, there can be used nonionic surface active agents such as saponin (steroid type), alkylene oxide derivatives (e.g., polyethylene glycol, polyethylene glycol/polypropylene glycol condensate, polyethylene glycol alkyl ether or polyethylene glycol alkylaryl ether, polyethylene glycol ester, polyethylene glycol sorbitan ester, polyalkylene glycol alkylamine or amide, polyethylene oxide adduct of silicone, etc.), glycidol derivatives (e.g., alkenylsuccinic acid polyglyceride, alkylphenol polyglyceride, etc.), fatty acid esters of polyhydric alcohols, and sugar alkyl esters; anionic surfactants having acidic groups such as carboxy group, sulfo group, phospho group, sulfuric ester group or phosphoric ester group, such as alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethylene alkylphenyl ethers, polyoxyethylene alkylphosphoric esters, etc.; amphoteric surfactants such as amino acids, aminoalkylsulfonic acids, aminoalkylsulfuric acid ester of aminoalkylphosphoric acid esters, alkylbetaines, amine oxides, etc.; and cationic surfactants such as alkylamine salts, aliphatic or aromatic quaternary ammonium salts, heterocyclic quaternary ammonium salts (e.g., pyridinium or imidazolium), aliphatic or hetero ring-containing phosphonium or sulfonium salts, etc., can be used.

The photographic light-sensitive material of the present invention may contain in its photographic emulsion layer polyalkylene oxide or its derivatives such as ether, ester or amide, thioether compounds, thiomorpholine compounds, quaternary ammonium salts, urethane derivatives, urea derivatives, imidazole derivatives, 3-pyrazolidones, etc., for raising sensitivity, contrast or development speed. For example, there can be used those described in U.S. Pat. Nos. 2,400,532, 2,423,549, 2,716,062, 3,617,280, 3,772,021, 3,808,003, British Pat. No. 1,488,991, etc.

The photographic light-sensitive material of the present invention can contain a water-insoluble or slightly water-soluble synthetic polymer in the photographic emulsion layer or other hydrophilic layer for improving dimensional stability. For example, there can be used polymers containing alkyl (meth)acrylate, alkoxyalkyl (meth)acrylate, glycidyl (meth)acrylate, (meth)acrylamide, vinyl ester (e.g., vinyl acetate), acrylonitrile, olefin, styrene, etc., alone or in combination or in further combination with acrylic acid, methacrylic acid, $\alpha,\beta$-unsaturated dicarboxylic acid, hydroxyalkyl (meth)acrylate, sulfoalkyl (meth)acrylate, styrenesulfonic acid, etc. For example, those described in U.S. Pat. Nos. 2,376,005, 2,739,173, 2,853,457, 3,062,674, 3,411,911, 3,488,708, 3,525,620, 3,607,290, 3,635,715, 3,645,740, British Pat. Nos. 1,186,699 and 1,307,373 can be used.

Photographic processing of the layer composed of the photographic emulsion of the present invention is conducted by applying known processes and known processing solutions as described in *Research Disclosure,* No. 176, pp. 28–30 (RD-17643). This photographic processing may be dye image-forming photographic processing (color photographic processing) as the occasion demands. Processing temperature is selected between 18° C. and 50° C. However, the temperature may be lower than 18° C. or higher than 50° C.

As a special type development processing, a developing agent may be incorporated in a light-sensitive material, for example, in an emulsion layer, the resulting light-sensitive material being processed in an alkaline aqueous solution to develop. Of the developing agents, hydrophobic ones can be incorporated in an emulsion according to various techniques described in *Research Disclosure,* 169 (RD-16928), U.S. Pat. No. 2,739,890, British Pat. No. 813,253, West German Pat. No. 1,547,763, etc. Such development processing may be combined with a processing of stabilizing silver salt with a thiocyanate.

As a fixing solution, those which have the same formulation as are ordinarily employed can be used. As a fixing agent, organic sulfur compounds which are known to function as fixing agents can be used as well as thiosulfates and thiocyanates. The fixing solution may contain an aqueous aluminum salt as a hardener.

In forming dye images, ordinary processes can be applied. For example, there may be employed a negative-positive process (described in, for example, *Journal of the Society of Motion Picture and Television Engineers,* Vol. 61 (1953), pp. 667–701.

A color developing solution generally comprises an alkaline aqueous solution containing a color-developing agent. As the color-developing agent, known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.) can be used.

In addition, those described in L. F. A. Mason, *Photographic Processing Chemistry,* (Focal Press, 1966), pp. 226–229, U.S. Pat. Nos. 2,193,015 and 2,592,364, Japanese Patent Application (OPI) No. 64933/73, etc., can be used.

To the color developing solution may further be added a pH buffer, a development inhibitor, an antifoggant, etc., and, if necessary, a water-softening agent, a preservative, an organic solvent, a development accelerator, a dye-forming coupler, a competitive coupler, an antifogging agent, an auxiliary developing agent, a viscosity-imparting agent, a polycarboxylic acid type chelating agent, an antioxidant, etc.

Specific examples of these additives are described in *Research Disclosure* (RD-17643), U.S. Pat. No. 4,083,723, West German (OLS) No. 2,622,950, etc.

The photographic emulsion layer is usually bleached after color development. This bleaching processing may be conducted independently or concurrently with fixing processing. As fixing agents, compounds of polyvalent metals such as iron(III), cobalt(III), chromium(VI), copper(II), etc., peracids, quinones, nitroso compounds, etc., are used.

For example, ferricyanides; dichromates; iron(III) or cobalt(II) organic complex salts such as organic complex salts of aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.); persulfates or permanganates; nitrosophenol; etc. Of these, potassium ferricyanide, ferric sodium ethylenediaminetetraacetate, and ferric ammonium ethylenediaminetetraacetate are particularly useful. Ferric ethylenediaminetetraacetate is useful in both as independent bleaching solution and a combined-bath bleach-fixing solution.

To the bleaching or bleach-fixing solution may be added various additives including bleaching accelerators described in U.S. Pat. Nos. 3,042,520, 3,241,966, Japanese Patent Publication Nos. 8506/70, 8836/70, etc., thiol compounds described in Japanese Patent Application (OPI) No. 65732/78, etc.

The photographic emulsion to be used in the present invention may be spectrally sensitized with methine dyes or the like. Useful sensitizing dyes are those described in, for example, German Pat. No. 929,080, U.S. Pat. Nos. 2,493,748, 2,503,776, 2,519,001, 2,912,329, 3,656,959, 3,672,897, 4,025,349, British Pat. No. 1,242,588, Japanese Patent Publication No. 14030/69, etc.

These sensitizing dyes may be used alone or in combination. Combination of sensitizing dyes is often employed particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609, 4,026,707, British Pat. No. 1,344,281, Japanese Patent Publication Nos. 4936/68 and 12375/78, and Japanese Patent Application (OPI) Nos. 110618/77 and 109925/77.

The photographic emulsion layers and other layers of the photographic light-sensitive material prepared by the present invention are coated on a flexible support such as plastic film, paper or cloth or on a rigid support such as glass, porcelain or metal, usually used for photographic light-sensitive materials. Useful flexible supports include films composed of semisynthetic or synthetic high polymers such as cellulose nitrate, cellulose acetate, cellulose acetate butyrate, polystyrene, polyvinyl chloride, polyethylene terephthalate, polycarbonate, etc., and papers coated or laminated with a baryta layer or an α-olefin polymer (for example, polyethylene, polypropylene, ethylene/butene copolymer, etc.). The support may be colored with a dye or a pigment, or may be blackened for intercepting light. The surface of the support is generally subbed for improving adhesion to a photographic emulsion layer or the like. The support surface may be subjected to corona discharge treatment, ultraviolet ray irradiation, or flame treatment before or after the subbing treatment.

The photographic emulsion layer and other hydrophilic colloid layers in the photographic light-sensitive material of the present invention can be coated on a support or other layer according to various known methods. Coating can be conducted according to a dip-coating method, roller coating method, curtain coating method, extrusion coating method, etc. Those described in U.S. Pat. Nos. 2,681,294, 2,761,791 and 3,526,528 are advantageous.

The present invention is applicable to a multilayered, multicolor photographic material having at least two light-sensitive layers with different spectral sensitivity on a support. Multilayered, natural color photographic materials usually possess at least one red-sensitive emulsion layer, one green-sensitive emulsion layer, and one blue-sensitive emulsion layer on a support. The order of these layers are arbitrarily selected as the occasion demands. Usually, the red-sensitive emulsion layer is associated with a cyan-forming coupler, the green-sensitive layer with a magenta-forming coupler and the blue-sensitive emulsion layer with a yellow-forming coupler, though different associations being employable in some cases.

Exposure for forming photographic image may be conducted in an ordinary manner. That is, known various light sources can be used such as natural light (sunlight), tungsten lamp, fluorescent lamp, mercury lamp, xenon arc lamp, carbon arc lamp, xenon flash lamp, cathode ray tube flying spot, etc. As to exposure time, an exposure time of 1/1,000 second to 1 second, employed for an ordinary camera, and an exposure time shorter than 1/1000 second, for example, $1/10^4$ to $1/10^6$ second using a xenon flash lamp or a cathode ray tube or an exposure time longer than 1 second may be employed. If necessary, spectral composition of the light used for the exposure can be adjusted by using a color filter. In addition, the photographic light-sensitive material of the present invention may be exposed by light emitted from a fluorescent substance excited with electron beams, X-rays, γ-rays, α-rays, etc.

The photographic light-sensitive material of the present invention contains in its photographic emulsion layers color-forming couplers capable of forming color by oxidative coupling with an aromatic primary amine developing agent (for example, a phenylenediamine derivative or an aminophenol derivative) in color development processing. For example, magenta couplers include 5-pyrazolone couplers, pyrazolobenzimidazole couplers, cyanoacetylcoumaron couplers, open-chain acylacetonitrile couplers, etc., yellow couplers include acylacetamide couplers (for example, benzoylacetanilides, pivaloylacetanilides, etc.), and cyan couplers include naphthol couplers and phenol couplers. Of these couplers, non-diffusible couplers having a hydrophobic group called a ballast group are desirable. The couplers may be of either 4-equivalent type or 2-equivalent type. Colored couplers having color-correcting effect or couplers capable of releasing a development inhibitor upon development (called DIR couplers) may also be used. In addition to DIR couplers, DIR coupling compounds capable of forming a colorless coupling reaction product may also be incorporated.

Specific examples of magenta color-forming couplers are those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, etc.

Specific examples of yellow color-forming couplers are those described in U.S. Pat. Nos. 2,875,057, 3,265,506, 3,408,194, 3,551,155, 3,582,322, 3,725,072, 3,891,445, West German Pat. No. 1,547,868, West German (OLS) Nos. 2,219,917, 2,261,361, 2,414,006, British Patent No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77, etc.

Specific examples of cyan couplers are those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German (OLS) Nos. 2,414,830, 2,454,329, Japanese Patent Application (OPI) Nos. 59838/73, 26034/76, 5055/73, 146828/76, 69624/77, 90932/77, etc.

As the colored couplers, those described in, for example, U.S. Pat. Nos. 3,476,560, 2,521,908, 3,034,892, Japanese Patent Publication Nos. 2016/69, 22335/63, 11304/67, 32461/69, Japanese Patent Application (OPI) Nos. 26034/76 and 42121/77, and West German (OLS) No. 2,418,959 can be used.

Useful DIR couplers include those described in U.S. Pat. Nos. 3,227,554, 3,617,291, 3,701,783, 3,790,384, 3,632,345, West German (OLS) Nos. 2,414,006, 2,454,301, 2,454,329, British Pat. No. 953,454, Japanese Patent Application (OPI) Nos. 69624/77, 122335/74, and Japanese Patent Publication No. 16141/76.

In addition to the DIR couplers, compounds capable of releasing a development inhibitor upon development may be incorporated in the light-sensitive material. For example, those described in U.S. Pat. Nos. 3,297,445 and 3,379,529, West German (OLS) No. 2,417,914, Japanese Patent Application (OPI) Nos. 15271/77 and 9116/78 can be used.

The photographic light-sensitive material in accordance with the present invention may contain an inorganic or organic hardener in its photographic emulsion layer or other hydrophilic colloid layer. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine), mucohalogenic acids (e.g., mucochloric acid, mucophenoxychloric acid, etc.), etc., can be used alone or in combination.

Where dyes or UV ray absorbents are incorporated in hydrophilic colloid layers of the light-sensitive material of the present invention, they may be mordanted with cationic polymers, and the like. For example, polymers described in British Pat. No. 685,475, U.S. Pat. Nos. 2,675,316, 2,839,401, 2,882,156, 3,048,487, 3,184,309, 3,445,231, West German (OLS) No. 1,914,362, Japanese Patent Application (OPI) Nos. 47624/75, 71332/75, etc., can be used.

The light-sensitive material of the present invention may contain a hydroquinone derivative, an aminophenol derivative, a gallic acid derivative, an ascorbic acid derivative, etc., as color fog-preventing agents.

The light-sensitive material prepared according to the present invention may contain an ultraviolet ray absorbent in its hydrophilic colloid layer. For example, aryl group-substituted benzotriazole compounds, 4-thiazolidone compounds, benzophenone compounds, cinnamate compounds, butadiene compounds, benzoxazole compounds, and UV ray-absorbing polymers can be used. These absorbents may be fixed in the above-described hydrophilic colloid layer.

Specific examples of the ultraviolet ray absorbents are described in U.S. Pat. Nos. 3,533,794, 3,314,794, 3,352,681, Japanese Patent Application (OPI) No. 2784/71, U.S. Pat. Nos. 3,705,805, 3,707,375, 4,045,229, 3,700,455, 3,499,762, West German Publication No. 1,547,863, etc.

The light-sensitive material prepared by the present invention may contain in its hydrophilic colloid layer a water-soluble dye as a filter dye or for various purposes such as prevention of irradiation. Such dyes include oxonol dyes, hemioxonol dyes, styryl dyes, merocyanine dyes, cyanine dyes, and azo dyes. Of these, oxonol dyes, hemioxonol dyes, and merocyanine dyes are particularly useful.

In practicing the present invention, the following known anti-fading agents can be used. The color image-stabilizing agents to be used in the present invention may be used alone or in combination of two or more. As the known anti-fading agents, there are hydroquinone derivatives, gallic acid derivatives, p-alkoxyphenols, p-hydroxyphenol derivatives, and bisphenols.

Specific examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801, 2,816,028, British Pat. No. 1,363,921, etc., specific examples of the gallic acid derivatives in U.S. Pat. Nos. 3,457,079, 3,069,262, etc., specific examples of the p-alkoxyphenols in U.S. Pat. Nos. 2,735,765, 3,698,909, Japanese Patent Publication Nos. 20977/74 and 6623/77, specific examples of the p-hydroxyphenol derivatives in U.S. Pat. Nos. 3,432,300, 3,573,050, 3,574,627, 3,764,337, Japanese Patent Application (OPI) Nos. 35633/77, 147434/77, 152225/77, etc., and specific examples of the bisphenols in U.S. Pat. No. 3,700,455.

The present invention will now be described in more detail by reference to the following non-limiting example.

EXAMPLE

The following layers were coated on a cellulose triacetate support to prepare a multilayered color light-sensitive material.

1st Layer

An antihalation layer comprising gelatin (1.5 g/m$^2$) containing black colloidal silver (0.18 g/m$^2$).

2nd Layer

An interlayer comprising gelatin (2.0 g/m$^2$).

3rd Layer

A first red-sensitive emulsion layer comprising a composition prepared by adsorbing Sensitizing Dyes I and II on a silver bromoiodide emulsion having a mean grain size of 0.5 μm and containing 6 mol% of silver iodide, adding thereto 4-hydroxy-6-methyl-1,3,3a,7-tetraazaindene, and mixing the product with an emulsion dispersion of Couplers C-1 and D-3.

| | |
|---|---|
| Ag | 1.8 g/m$^2$ |
| Gelatin | 2.4 g/m$^2$ |
| Sensitizing Dye I | $1.4 \times 10^{-4}$ mol/mol Ag |
| Sensitizing Dye II | $6.2 \times 10^{-5}$ mol/mol Ag |
| Coupler C-1 | 0.07 mol/mol Ag |
| Coupler D-3 | 0.0014 mol/mol Ag |

The emulsion dispersion of Couplers C-1 and D-3 was prepared by first dissolving them in a mixed solvent of tricresyl phosphate and ethyl acetate, mixing the solution with a gelatin solution containing sodium di(2-ethylhexyl)-α-sulfosuccinate, then emulsifying and dispersing through mechanical high speed stirring.

4th Layer

A second red-sensitive layer comprising a composition prepared by adsorbing Sensitizing Dyes I and II on a silver bromoiodide emulsion having a mean grain size of 0.6μ and containing 6 mol% silver iodide, adding thereto 4-hydroxy-6-methyl-1,3,3a,7-tetraazaindene, and mixing the product with an emulsion despersion of Couplers C-1 and C-2.

| | |
|---|---|
| Ag | 1.2 g/m$^2$ |
| Gelatin | 1.1 g/m$^2$ |
| Sensitizing Dye I | $1.2 \times 10^{-4}$ mol/mol Ag |
| Sensitizing Dye II | $5.5 \times 10^{-5}$ mol/mol Ag |
| Coupler C-1 | 0.036 mol/mol Ag |
| Coupler C-2 | 0 0064 mol/mol Ag |

The emulsion dispersion of Couplers C-1 and C-2 was prepared in the same manner as with that of the first red-sensitive layer.

5th Layer

An interlayer (gelatin: 1.1 g/m$^2$) containing 2,5-di-t-octylhydroquinone (0.05 g/m$^2$).

6th Layer

A first green-sensitive emulsion layer comprising a composition prepared by adsorbing Sensitizing Dyes III and IV on a silver bromoiodide emulsion having a mean grain size of 0.4 μm and containing 4 mol% silver iodide, adding thereto 4-hydroxy-6-methyl-1,3,3a,7-tetraazaindene, and mixing the resulting product with an emulsion dispersion of Couplers M-1, M-2 and D-1.

| | |
|---|---|
| Ag | 1.2 g/m$^2$ |
| Gelatin | 1.8 g/m$^2$ |
| Sensitizing Dye III | 2.3 × 10−4 mol/mol Ag |
| Sensitizing Dye IV | 1.4 × 10−4 mol/mol Ag |
| Coupler M-1 | 0.075 mol/mol Ag |
| Coupler M-2 | 0.020 mol/mol Ag |
| Coupler D-3 | 0.0050 mol/mol Ag |

The emulsion dispersion of Couplers M-1, M-2, and D-3 was prepared by dissolving them in a mixed solvent of tricresyl phosphate, dibutyl phthalate, and ethyl acetate, mixing the solution with a gelatin solution containing sodium dodecylbenzenesulfonate, then subjecting to mechanical high speed stirring to emulsify and disperse.

7th Layer

A second green-sensitive emulsion layer comprising a composition prepared by adsorbing Sensitizing Dyes III and IV on a silver bromoiodide emulsion having a mean grain size of 0.7 μm and containing 6 mol% of silver iodide, adding thereto 4-hydroxy-6-methyl-1,3,3a,7-tetraazaindene, and mixing the product with an emulsion dispersion of Couplers M-1 and M-2.

| | |
|---|---|
| Ag | 1.6 g/m$^2$ |
| Gelatin | 1.4 g/m$^2$ |
| Sensitizing Dye III | $1.6 \times 10^{-4}$ mol/mol Ag |
| Sensitizing Dye IV | $9.7 \times 10^{-5}$ mol/mol Ag |
| Coupler M-1 | 0.015 mol/mol Ag |
| Coupler M-2 | 0.0035 mol/mol Ag |

The emulsion dispersion of Couplers M-1 and M-2 was prepared in the same manner as with the first green-sensitive layer.

8th Layer

An interlayer (gelatin: 1.4 g/m$^2$) containing an emulsion dispersion of yellow colloidal silver (0.12 g/m$^2$) and 2,5-di-t-octylhydroquinone (0.10 g/m$^2$).

9th Layer

A first blue-sensitive emulsion layer comprising a composition prepared by adsorbing Sensitizing Dye V on a silver bromoiodide emulsion having a mean grain size of 0.55 μm and containing 5.5 mol% of silver iodide, adding thereto 4-hydroxy-6-methyl-1,3,3a,7-tetraazaindene and mixing the product with an emulsion dispersion of Couplers Y-1 and D-3.

| | |
|---|---|
| Ag | 0.65 g/m$^2$ |
| Gelatin | 1.65 g/m$^2$ |
| Sensitizing Dye V | $6.1 \times 10^{-5}$ mol/mol Ag |
| Coupler Y-1 | 0.28 mol/mol Ag |

-continued

| | |
|---|---|
| Coupler D-3 | 0.0092 mol/mol Ag |

The emulsion dispersion of Couplers Y-1 and D-3 was prepared by dissolving them in a mixed solvent of tricresyl phosphate and ethyl acetate, mixing the solution with a gelatin solution containing sodium dodecylbenzenesulfonate, and subjecting to mechanical high speed stirring to emulsify and disperse.

10th Layer

A second blue-sensitive emulsion layer comprising a composition prepared by adsorbing Sensitizing Dye V on a silver bromoiodide emulsion having a mean grain size of 0.80 μm and containing 7.5 mol% of silver iodide, adding thereto 4-hydroxy-6-methyl-1,3,3a,7-tetraazaindene and mixing the product with an emulsion dispersion of Coupler Y-1.

| | |
|---|---|
| Ag | 0.82 g/m$^2$ |
| Gelatin | 0.93 g/m$^2$ |
| Sensitizing Dye V | $4.2 \times 10^{-5}$ mol/mol Ag |
| Coupler Y-1 | 0.060 mol/mol Ag |

The emulsion dispersion of Coupler Y-1 was prepared in the same way as with the coupler in the first blue-sensitive emulsion layer.

11th Layer

A protective layer (gelatin: 1.5 g/m$^2$) containing methyl methacrylate particles (0.02 g/m$^2$) having a mean particle size of 0.18 μm.

To each of the above-described 1st to 11th layers were added a gelatin hardener of 2-hydroxy-4,6-dichloro-s-triazine sodium salt and a coating aid. The thus-prepared sample was referred to as Sample a.

Sample b was prepared in the same manner as with Sample a except for replacing Coupler D-3 in the first red-sensitive layer, first green-sensitive emulsion layer, and first blue-sensitive emulsion layer in Sample a by EX-1 in amounts of 1.2 mols, 1.1 mols, and 0.8 mol per mol of D-3, respectively.

Sample c1 was prepared in the same manner as with Sample a except for replacing Sensitizing Dyes I and II in the red-sensitive 3rd layer of Sample a by $1.4\times10^{-4}$ mol/mol Ag of Sensitizing Dye I, $3.1\times10^{-5}$ mol/mol Ag of Sensitizing Dye II, and $1.0\times10^{-5}$ mol/mol Ag of Sensitizing Dye VI and changing the amounts of Sensitizing Dyes I, II and VI in the red-sensitive 4th layer to $1.2\times10^{-4}$, $2.7\times10^{-5}$ and $8.9\times10^{-6}$ mol/mol Ag, respectively.

Sample c2 was prepared in the same manner as with Sample a except for replacing Sensitizing Dyes III and IV in the green-sensitive 6th emulsion layer of Sample a by $1.1\times10^{-4}$ mol/mol Ag of Sensitizing Dye III and $2.3\times10^{-4}$ mol/mol Ag of VII and changing the amounts of Sensitizing Dyes III and VII in the 7th layer to $8\times10^{-5}$ mol/mol Ag and $1.6\times10^{-4}$ mol/mol Ag, respectively.

Sample c3 was prepared in the same manner as with Sample a except for changing the amounts of Sensitizing Dyes III and IV in the green-sensitive 6th layer of Sample a to $1.5\times10^{-4}$ and $2.1\times10^{-4}$ mol/mol Ag, respectively, and changing the amounts in the 7th layer to $7.7\times10^{-5}$ and $1.5\times10^{-4}$ mol/mol Ag, respectively.

Further, Samples d and e were prepared in the same manner as with Sample a except for replacing Coupler D-3 in the first red-sensitive emulsion layer, the first green-sensitive emulsion layer, and first blue-sensitive emulsion layer by equimolar amounts of D-16 or D-15.

When Samples a, b, c1, c2, c3, d and e were wedge-exposed to 4,800° K. white light and subjected to the following color development processing, they provided almost the same sensitivity and gradation.

Development processing employed was as follows.

| | |
|---|---|
| 1. Color Development | 3 min 15 sec (38° C.) |
| 2. Bleaching | 6 min 30 sec |
| 3. Washing with Water | 3 min 15 sec |
| 4. Fixing | 6 min 30 sec |
| 5. Washing with Water | 3 min 15 sec |
| 6. Stabilizing | 3 min 15 sec |

Formulations of the processing solutions used in respective steps are as follows.

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution | |
| Ammonium Bromide | 160.0 g |
| Aqueous Ammonia (28%) | 25.0 ml |
| Sodium Ferric Ethylenediaminetetra-acetate | 130 g |
| Glacial Acetic Acid | 14 ml |
| Water to make | 1 liter |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 liter |
| Stabilizing Solution | |
| Formalin | 8.0 ml |
| Water to make | 1 liter |

Structural formulae of the compounds used in Samples a to e are as follows.

I

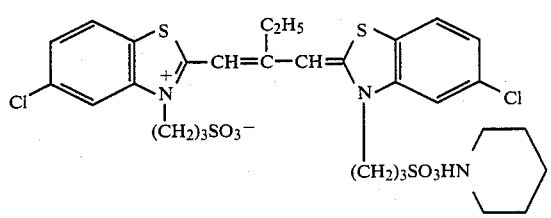

-continued
II
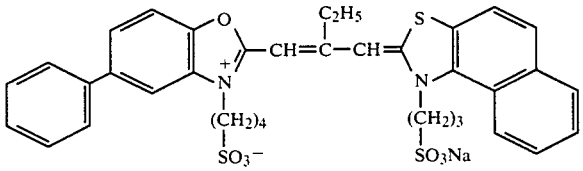
III
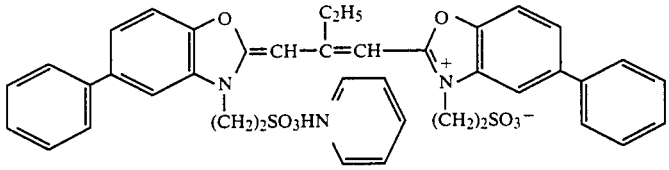
IV
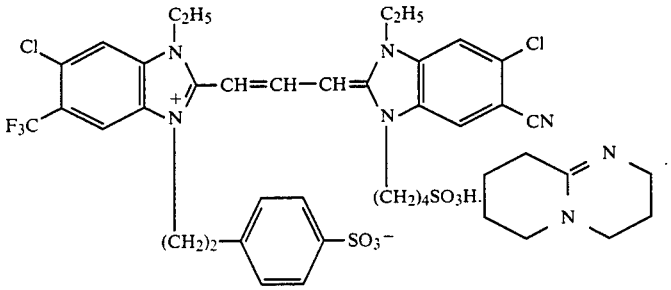
V
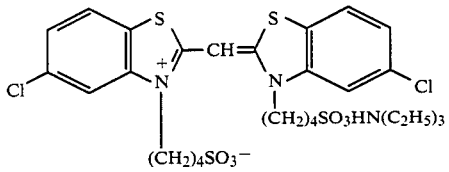
VI
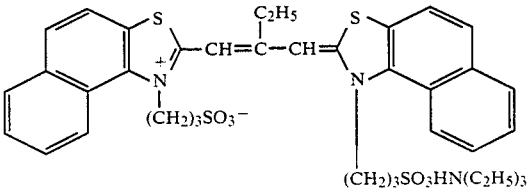
VII
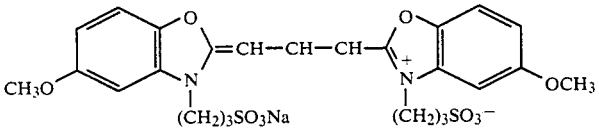
C-1
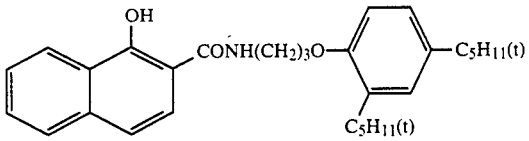
C-2
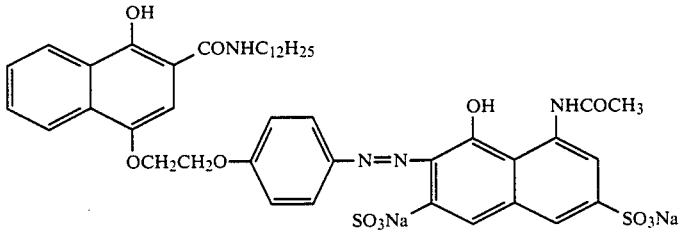

-continued

M-1

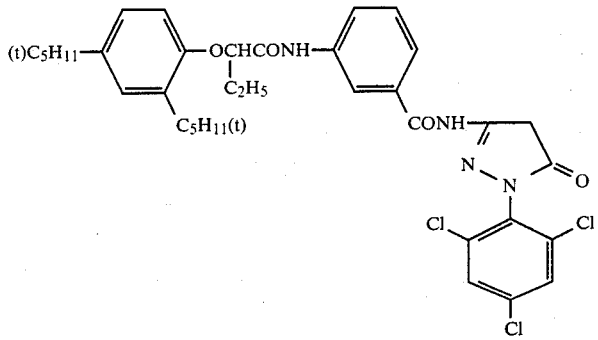

M-2

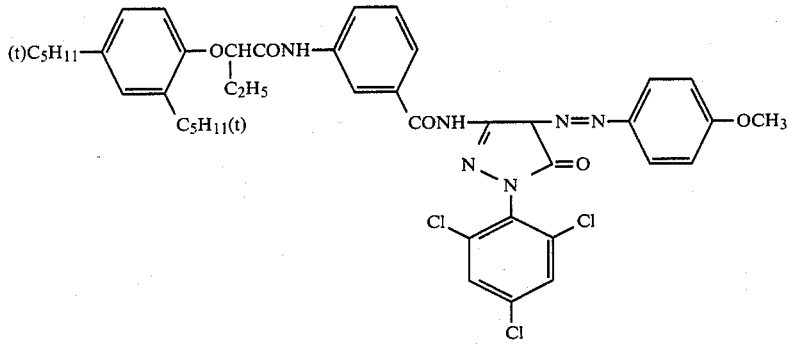

Y-1

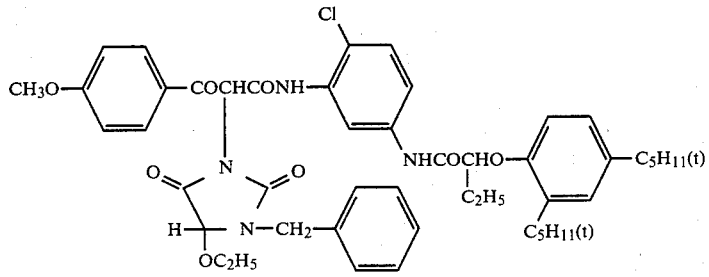

EX-1

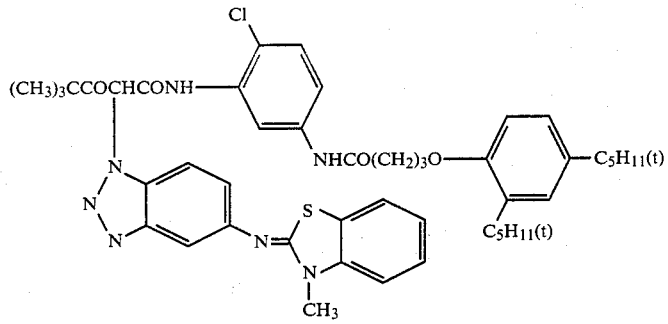

Maximum sensitivity wavelengths of the light-sensitive layers of Samples a to e are as follows.

| | Blue-Sensitive Layer (μ) | Green-Sensitive Layer (μ) | Red-Sensitive Layer (μ) |
|---|---|---|---|
| Sample a | 452 | 550 | 638 |
| b | 452 | 550 | 638 |
| c1 | 452 | 550 | 655 |
| c2 | 452 | 535 | 638 |
| c3 | 452 | 569 | 638 |
| d | 452 | 550 | 638 |

-continued

| | Blue-Sensitive Layer (μ) | Green-Sensitive Layer (μ) | Red-Sensitive Layer (μ) |
|---|---|---|---|
| e | 452 | 550 | 638 |

A color chart having gray, red, green, blue, cyan, magenta and yellow portions was photographed using Samples a to e. After the aforesaid development processing, the chart was printed on color papers. Reflection densities of the three primary color components of subtractive color photography were measured with each image. The results thus obtained are shown in Table 2.

With Sample b which has improved color sensitivity, change in mutual relation between the densities of the three components due to the change of light source is smaller than that of Samples c1 to c3, thus Sample b having good light source independence. With saturation, however, Component M in green is higher than that of Samples c1 to c3. Therefore, green saturation of Sample b is poorer than that of Samples c1 to c3.

On the other hand, Sample a showed almost approximate C, M and Y values of red, green, blue, cyan, magenta and yellow to those of Samples c1 to c3, thus being improved with respect to the defect of Sample b.

Samples d and e using, respectively, couplers of 0.42 and 0.5 in diffusibility are clearly improved over Sample b with respect to, for example, green saturation. Thus, DIR compounds having a DI component of 0.4 or more in diffusibility clearly contribute to the improvement of color reproducibility. That is, any side effects concurrently caused by the improvement of color sensitivity were completely eliminated. Thus, the effects of the present invention are completely demonstrated.

TABLE 2

| | Dependence on Light Source | | | | | | | | | Saturation (photographed under day light) | | | | | |
|---|---|---|---|---|---|---|---|---|---|---|---|---|---|---|---|
| | *1 | | | *2 | | | *3 | | | *4 | | | *5 | | |
| Sample | C | M | Y | C | M | Y | C | M | Y | C | M | Y | C | M | Y |
| a* | 0.69 | 0.67 | 0.62 | 0.63 | 0.65 | 0.67 | 0.66 | 0.58 | 0.67 | 0.36 | 1.82 | 1.67 | 1.40 | 0.72 | 1.47 |
| b** | 0.70 | 0.65 | 0.60 | 0.63 | 0.65 | 0.68 | 0.69 | 0.57 | 0.67 | 0.40 | 1.80 | 1.64 | 1.51 | 0.88 | 1.60 |
| c1** | 0.72 | 0.67 | 0.61 | 0.56 | 0.66 | 0.66 | 0.69 | 0.56 | 0.67 | 0.37 | 1.78 | 1.66 | 1.43 | 0.72 | 1.46 |
| c2** | 0.69 | 0.66 | 0.58 | 0.64 | 0.68 | 0.63 | 0.65 | 0.63 | 0.65 | 0.38 | 1.91 | 1.67 | 1.45 | 0.78 | 1.43 |
| C3** | 0.72 | 0.67 | 0.61 | 0.66 | 0.59 | 0.66 | 0.69 | 0.42 | 0.65 | 0.39 | 1.61 | 1.62 | 1.43 | 0.77 | 1.42 |
| d* | 0.69 | 0.66 | 0.60 | 0.64 | 0.66 | 0.67 | 0.68 | 0.56 | 0.66 | 0.41 | 1.84 | 1.67 | 1.49 | 0.80 | 1.55 |
| e* | 0.70 | 0.66 | 0.61 | 0.63 | 0.65 | 0.67 | 0.69 | 0.58 | 0.68 | 0.36 | 1.77 | 1.65 | 1.45 | 0.77 | 1.50 |

| | Saturation (photographed under day light) | | | | | | | | | | | |
|---|---|---|---|---|---|---|---|---|---|---|---|---|
| | *6 | | | *7 | | | *8 | | | *9 | | |
| Sample | C | M | Y | C | M | Y | C | M | Y | C | M | Y |
| a* | 2.02 | 1.58 | 0.82 | 1.54 | 0.72 | 0.54 | 0.27 | 0.99 | 0.43 | 0.17 | 0.39 | 1.39 |
| b** | 1.86 | 1.42 | 0.79 | 1.47 | 0.72 | 0.54 | 0.23 | 0.88 | 0.39 | 0.20 | 0.58 | 1.47 |
| c1** | 2.00 | 1.54 | 0.79 | 1.56 | 0.72 | 0.54 | 0.30 | 0.98 | 0.44 | 0.18 | 0.42 | 1.42 |
| c2** | 2.00 | 1.42 | 0.83 | 1.44 | 0.74 | 0.56 | 0.26 | 0.86 | 0.41 | 0.17 | 0.62 | 1.39 |
| c3** | 2.00 | 1.70 | 0.77 | 1.57 | 0.83 | 0.49 | 0.33 | 0.73 | 0.41 | 0.19 | 0.41 | 1.37 |
| d* | 1.88 | 1.44 | 0.78 | 1.46 | 0.69 | 0.52 | 0.22 | 0.90 | 0.37 | 0.20 | 0.50 | 1.44 |
| e* | 1.95 | 1.50 | 0.80 | 1.51 | 0.71 | 0.53 | 0.25 | 0.97 | 0.37 | 0.18 | 0.45 | 1.40 |

Note:
*1 Print density of gray patch photographed under day light
*2 Print density of gray patch photographed under tungsten light
*3 Print density of gray patch photographed under fluorescent lamp
*4 Density of red patch
*5 Density of green patch
*6 Density of blue patch
*7 Density of cyan patch
*8 Density of magenta patch
*9 Density of yellow patch
*Present Invention
**Comparative Example
C, M and Y respectively stand for densities of cyan, magenta and yellow which are three primary colors in subtractive color photography.

Sample c1 was prepared in the same manner as Sample a except for replacing Sensitizing Dyes I and II in the red-sensitive 3rd layer of Sample a by $1.4\times10^{-4}$ mol/mol Ag of I, $3.1\times10^{-5}$ mol/mol Ag of II, and $1.0\times10^{-5}$ mol/mol Ag of VI, and changing the amounts of I, II and VI in the 4th layer to $1.2\times10^{-5}$, $2.7\times10^{-5}$ and $8.9\times10^{-6}$ mol/mol Ag, respectively.

Sample c2 was prepared in the same manner as Sample a except for replacing Dyes III and IV in the 6th green-sensitive layer of Sample a by $1.1\times10^{-4}$ mol/mol Ag of III, and $2.3\times10^{-4}$ mol/mol Ag of VII and changing the amounts of III and VII in the 7th layer to $8\times10^{-5}$ and $1.6\times10^{-4}$ mol/mol Ag, respectively.

Sample c3 was prepared in the same manner as Sample a except for changing the amounts of Sensitizing Dyes II and IV in the 6th green-sensitive layer of Sample a to $1.5\times10^{-4}$ and $2.1\times10^{4}$ mol/mol Ag, respectively, and the amounts of III and IV in the 7th layer to $7.7\times10^{-5}$ and $1.5\times10^{-4}$ mol/mol Ag, respectively.

Samples d1 to d3 were prepared in the same manner as Samples c1 to c3 except for replacing Coupler D-3 in the first red-sensitive emulsion layer, first green-sensitive emulsion layer, and first blue-sensitive emulsion layer by D-4 in amounts of 1.2 mols, 1.1 mols and 0.8 mol per mol of D-3, respectively.

Samples a, b, c1, c2, c3, d1, d2 and d3 were wedge-exposed using 4,800° K. white light and subjected to the following color development processing to obtain almost the same sensitivity and gradation.

It is clear that Sample a in accordance with the present invention shows the unexpectable effect of reducing dependence on light source without deteriorating saturation.

| | Maximum Sensitivity Wavelength of Light-Sensitive Layer of Each Sample | | |
|---|---|---|---|
| | Blue-Sensitive Layer | Green-Sensitive Layer | Red-Sensitive Layer |
| Sample a | 452 | 550 | 638 |
| b | " | " | " |
| c1 | " | " | 655 |
| c2 | " | 535 | 638 |
| c3 | " | 569 | " |
| d1 | " | 550 | 655 |
| d2 | " | 535 | 638 |
| d3 | " | 569 | " |

While the invention has been described in detail and with reference to specific embodiments thereof, it will be apparent to one skilled in the art that various changes and modifications can be made therein without departing from the spirit and scope thereof.

What is claimed is:

1. A silver halide multilayered color photographic light-sensitive material, comprising:

a support base having thereon:

a green-sensitive emulsion layer for forming a magenta color, the green-sensitive layer having a maximum sensitivity in the range of 535 nm to 555 nm;

a blue-sensitive emulsion layer for forming a yellow color, the blue-sensitive layer having a maximum sensitivity in the range of 80 to 110 nm shorter than the maximum sensitivity of the green-sensitive layer; and a red-sensitive emulsion layer for forming a cyan color, the red-sensitive layer having a maximum sensitivity in the range of 75 to 95 nm longer than that of the green-sensitive layer; and a compound capable of releasing a diffusible development inhibitor or its precursor, wherein the development inhibitor or its precursor has a diffusibility of 0.4 or more, by a coupling reaction with the oxidation product of a color developing agent.

2. A silver halide material as claimed in claim 1, wherein the compound capable of releasing the diffusible development inhibitor or its precursor is present in a layer selected from the group consisting of the green-sensitive layer, the blue-sensitive layer and the red-sensitive layer.

3. A silver halide material as claimed in claim 1, wherein the compound capable of releasing a diffusible development inhibitor or its precursor is present in a light-insensitive interlayer adjacent to a layer selected from the group consisting of the green-sensitive layer, the blue-sensitive layer and the red-sensitive layer.

4. A silver halide material as claimed in claim 3, wherein the compound capable of releasing a diffusible development inhibitor or its precursor is present in an amount in the range of 0.01 to 50 mol% based on the amount of silver halide in the adjacent emulsion layer.

5. A silver halide material as claimed in claim 4, wherein the compound capable of releasing a diffusible development inhibitor or its precursor is present in an amount in the range of 0.1 to 5 mol% based on the amount of silver halide in the adjacent emulsion layer.

6. A silver halide material as claimed in claim 4, wherein the compound capable of releasing a diffusible development inhibitor or its precursor is represented by the general formula (I):

$$J\text{-}(Y)_h \qquad (I)$$

wherein J is a coupler component, h is 1 or 2 and Y is a group bound to the coupling position of coupler component J to be eliminated by the reaction with the oxidation product of a color developing agent to form a development inhibitor or a development inhibitor-releasing compound.

7. A silver halide material as claimed in claim 6, wherein the Y is a compound selected from the group consisting of (II), (III), (IV) and (V):

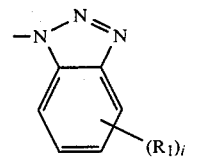
(II)

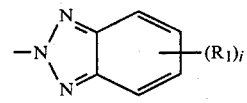
(III)

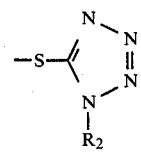
(IV)

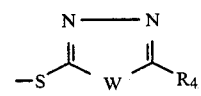
(V)

wherein W is —S— or —N($R_3$)—, $R_1$, $R_2$, $R_3$ and $R_4$ are each a substituent selected so as to adjust the diffusibility to 0.4 or more, and i represents 1 or 4.

8. A silver halide material as claimed in claim 7, wherein J is selected from the group consisting of a yellow image-forming coupler residue, a magenta image-forming coupler residue and a cyan image-forming coupler residue.

9. A silver halide material as claimed in claim 4, wherein the compound capable of releasing a diffusible development inhibitor or its precursor is the compound (D-1):

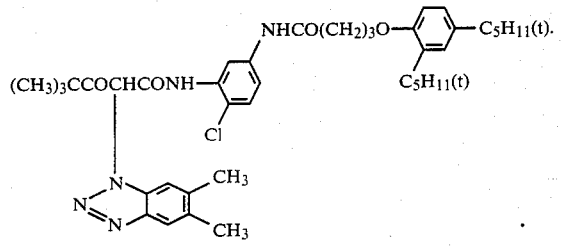

10. A process for reducing changes in the color reproducability of a silver halide multilayer color photographic light-sensitive material caused by changes in the color temperature of a light source used to expose the same upon photography, which process comprises:

setting the maximum sensitivity of a green-sensitive layer of said light-sensitive material at 535 to 555 nm, the maximum sensitivity of a blue-sensitive layer of said light-sensitive material at a wavelength 80 to 110 nm shorter than that of said green-sensitive layer, and the maximum sensitivity of a red-sensitive layer of said light-sensitive material at a wavelength 75 to 95 nm longer than that of said green-sensitive layer; and developing said light-sensitive material in the presence of a compound capable of releasing a diffusible development inhibitor or its precursor, wherein said development inhibitor or its precursor has a diffisibility of 0.4 or more, by a coupling reaction with the oxidation product of a color developing agent, said compound being present in said light-sensitive material.

11. A process for producing images in a silver halide multilayer color photographic light-sensitive material which shows reduced changes in color reproducability due to changes in the color temperature of the light source used to expose the same upon photography, which process comprises:

setting the maximum sensitivity of a green-sensitive layer of said light-sensitive material at 535 to 555 nm, the maximum sensitivity of a blue-sensitive layer of said light-sensitive material at a wavelength 80 to 110 nm shorter than that of said green-sensitive layer, and the maximum sensitivity of a red-sensitive layer of said light-sensitive material at a wavelength 75 to 95 nm longer than that of said green-sensitive layer;

image-wise exposing said silver halide multi-layer color photographic material to said light source; and developing said light-sensitive material in the presence of a compound capable of releasing a diffusible development inhibitor or its precursor, wherein said development inhibitor or its precursor has a diffisibility of 0.4 or more, by a coupling reaction with the oxidation product of a color developing agent, said compound being present in said light-sensitive material.

12. A silver halide material as claimed in claim 4, wherein the compound capable of releasing the diffusible development inhibitor or its precursor is present in each of the green-sensitive, blue-sensitive and red-sensitive emulsion layers.

13. A silver halide material as claimed in claim 5, wherein the compound capable of releasing the diffusible development inhibitor or its precursor is present in each of the green-sensitive, blue-sensitive and red-sensitive emulsion layers.

14. The process of claim 10, wherein the compound capable of releasing the diffusible development inhibitor or its precursor is present in a layer selected from the group consisting of the green-sensitive layer, the blue-sensitive layer and the red-sensitive layer.

15. The process of claim 10, wherein the compound capable of releasing a diffusible development inhibitor or its precursor is present in a light-insensitive interlayer adjacent to a layer selected from the group consisting of the green-sensitive layer, the blue-sensitive layer and the red-sensitive layer.

16. The process of claim 15, wherein the compound capable of releasing a diffusible development inhibitor or its precursor is present in an amount in the range of 0.01 to 50 mol% based on the amount of silver halide in the adjacent emulsion layer.

17. The process of claim 16, wherein the compound capable of releasing a diffusible development inhibitor or its precusor is present in an amount in the range of 0.1 to 5 mol% based on the amount of silver halide in the adjacent emulsion layer.

18. The process of claim 16, wherein the compound capable of releasing a diffusible development inhibitor or its precursor is represented by the general formula (I):

$$J\text{-}(Y)_h \qquad (I)$$

wherein J is a coupler component, h is 1 or 2 and Y is a group bound to the coupling position of coupler component J to be eliminated by the reaction with the oxidation product of a color developing agent to form a development inhibitor or a development inhibitor-releasing compound.

19. The process of claim 16, wherein the Y is a compound selected from the group consisting of (II), (III), (IV) and (V):

(II)

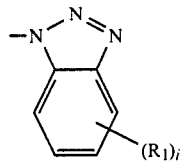

(III)

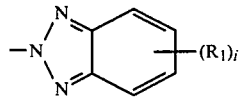

(IV)

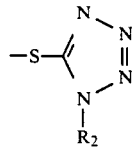

(V)

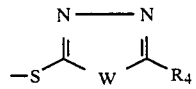

wherein W is —S— or —N($R_3$)—, $R_1$, $R_2$, $R_3$ and $R_4$ are each a substituent selected so as to adjust the diffusiblity to 0.4 or more, and i represents 1 or 4.

20. The process of claim 19, wherein J is selected from the group consisting of a yellow image-forming coupler residue, a magenta image-forming coupler residue and a cyan image-forming coupler residue.

21. The process of claim 16, wherein the compound capable of releasing a diffusible development inhibitor or its precursor is the compound (D-1):

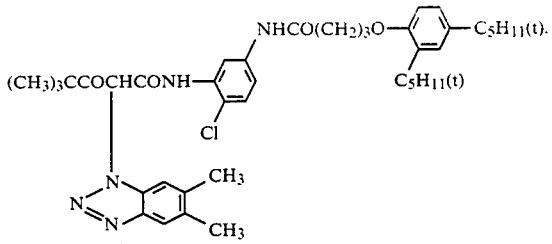

22. The process of claim 11, wherein the compound capable of releasing the diffusible development inhibitor or its precursor is present in a layer selected from the group consisting of the green-sensitive layer, the blue-sensitive layer and the red-sensitive layer.

23. The process of claim 11, wherein the compound capable of releasing a diffusible development inhibitor or its precursor is present in a light-insensitive interlayer adjacent to a layer selected from the group consisting of the green-sensitive layer, the blue-sensitive layer and the red-sensitive layer.

24. The process of claim 23, wherein the compound capable of releasing a diffusible development inhibitor or its precursor is present in an amount in the range of 0.01 to 50 mol% based on the amount of silver halide in the adjacent emulsion layer.

25. The process of claim 23, wherein the compound capable of releasing a diffusible development inhibitor or its precursor is present in an amount in the range of 0.1 to 5 mol% based on the amount of silver halide in the adjacent emulsion layer.

26. The process of claim 23, wherein the compound capable of releasing a diffusible development inhibitor or its precursor is represented by the general formula (I):

$$J\text{-}(Y)_h \qquad (I)$$

wherein J is a coupler component, h is 1 or 2 and Y is a group bound to the coupling position of coupler component J to be eliminated by the reaction with the oxidation product of a color developing agent to form a development inhibitor or a development inhibitor-releasing comopund.

27. The process of claim 11, wherein the Y is a compound selected from the group consisting of (II), (III), (IV) and (V):

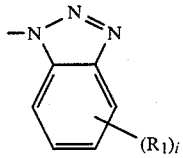

(II)

-continued

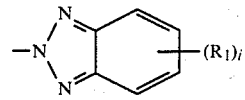

(III)

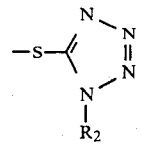

(IV)

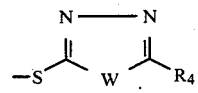

(V)

wherein W is —S— or —N($R_3$)—, $R_1$, $R_2$, $R_3$ and $R_4$ are each a substituent selected so as to adjust the diffusiblity to 0.4 or more, and i represents 1 or 4.

28. The process of claim 27, wherein J is selected from the group consisting of a yellow image-forming coupler residue, a magenta image-forming coupler residue and a cyan image-forming coupler residue.

29. The process of claim 11, wherein the compound capable of releasing a diffusible development inhibitor or its precursor is the compound (D-1):

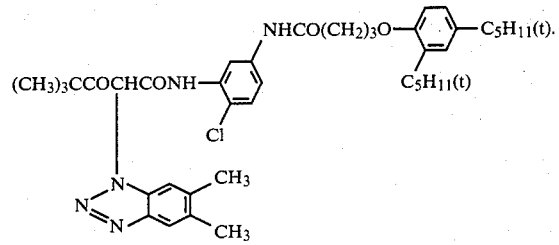

* * * * *